US011277705B2

(12) United States Patent
McGrath

(10) Patent No.: US 11,277,705 B2
(45) Date of Patent: Mar. 15, 2022

(54) METHODS, SYSTEMS AND APPARATUS FOR CONVERSION OF SPATIAL AUDIO FORMAT(S) TO SPEAKER SIGNALS

(71) Applicant: Dolby Laboratories Licensing Corporation, San Francisco, CA (US)

(72) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/613,101

(22) PCT Filed: May 14, 2018

(86) PCT No.: PCT/US2018/032500

§ 371 (c)(1),
(2) Date: Nov. 12, 2019

(87) PCT Pub. No.: WO2018/213159

PCT Pub. Date: Nov. 22, 2018

(65) Prior Publication Data

US 2020/0178015 A1 Jun. 4, 2020

Related U.S. Application Data

(60) Provisional application No. 62/506,294, filed on May 15, 2017.

(30) Foreign Application Priority Data

May 15, 2017 (EP) ..... 17170992

(51) Int. Cl.
*H04S 7/00* (2006.01)
*H04R 5/02* (2006.01)
(Continued)

(52) U.S. Cl.
CPC ..... *H04S 7/303* (2013.01); *H04R 5/02* (2013.01); *H04R 5/04* (2013.01); *H04S 3/008* (2013.01);
(Continued)

(58) Field of Classification Search
CPC . H04S 7/303; H04S 3/008; H04S 3/02; H04S 2400/01; H04S 2400/11; H04S 2420/11; H04R 5/02; H04R 5/04
(Continued)

(56) References Cited

U.S. PATENT DOCUMENTS 6,628,787 B1 9/2003 McGrath
8,103,006 B2 * 1/2012 McGrath ..... H04S 3/02 381/20
(Continued)

FOREIGN PATENT DOCUMENTS

CN 104041074 9/2014
CN 104205879 12/2014
(Continued)

OTHER PUBLICATIONS

Franz, All-Round Ambisonic Panning and Decoding, 2012, AES, p. 807-p. 817 (Year: 2012).*
(Continued)

*Primary Examiner* — William A Jerez Lora

(57) ABSTRACT

The present disclosure relates to a method of converting an audio signal in an intermediate signal format to a set of speaker feeds suitable for playback by an array of speakers. The audio signal in the intermediate signal format is obtainable from an input audio signal by means of a spatial panning function. The method comprises determining a discrete panning function for the array of speakers, determining a target panning function based on the discrete panning function, wherein determining the target panning
(Continued)

function involves smoothing the discrete panning function, and determining a rendering operation for converting the audio signal in the intermediate signal format to the set of speaker feeds, based on the target panning function and the spatial panning function. The present disclosure further relates to a corresponding apparatus and a corresponding computer-readable storage medium.

16 Claims, 15 Drawing Sheets

(51) Int. Cl.
*H04R 5/04* (2006.01)
*H04S 3/00* (2006.01)
*H04S 3/02* (2006.01)

(52) U.S. Cl.
CPC ..... *H04S 3/02* (2013.01); *H04S 2400/01* (2013.01); *H04S 2400/11* (2013.01); *H04S 2420/11* (2013.01)

(58) Field of Classification Search
USPC ..... 381/1, 2, 303, 307
See application file for complete search history.

(56) References Cited

U.S. PATENT DOCUMENTS

| | | | |
|---|---|---|---|
| 8,705,750 | B2 | 4/2014 | Berge |
| 9,078,077 | B2 | 7/2015 | Hultz |
| 9,100,768 | B2 | 8/2015 | Batke |
| 2011/0216906 | A1 | 9/2011 | Swaminathan |
| 2011/0249819 | A1 | 10/2011 | Davis |
| 2013/0010970 | A1 | 1/2013 | Hegarty |
| 2015/0081310 | A1* | 3/2015 | Keiler ..... H04S 1/007 704/500 |
| 2015/0163615 | A1 | 6/2015 | Boehm |
| 2015/0170657 | A1 | 6/2015 | Thompson |
| 2015/0223002 | A1 | 8/2015 | Mehta |
| 2016/0035356 | A1 | 2/2016 | Morrell |
| 2016/0073199 | A1 | 3/2016 | Elko |

FOREIGN PATENT DOCUMENTS

| | | |
|---|---|---|
| CN | 104956695 | 9/2015 |
| CN | 105284132 | 1/2016 |
| CN | 105637901 | 6/2016 |
| CN | 106575506 | 4/2017 |
| EP | 2645748 | 2/2013 |
| WO | 0019415 | 4/2000 |
| WO | 2015048387 A1 | 4/2015 |
| WO | 2017036609 | 3/2017 |

OTHER PUBLICATIONS

Pulkki, Ville "Virtual Sound Source Positioning Using Vector Base Amplitude Panning" J. Audio Eng. Soc., vol. 45, No. 6, Jun. 1997, pp. 456-466.
Seo, J. et al "21-Channel Surround System Based on Physical Reconstruction of a Three Dimensional Target Sound Field" AES Convention May 2010.
Zotter, F. et al, "All-Round Ambisonic Panning and Decoding", J. Audio Eng. Soc., vol. 60, No. 10, Oct. 2012, pp. 807-820.
Hui Zhe, Gong "The Improvement for Ambisonic System Optimization", a Dissertation submitted for the degree of Doctor of Philosophy, Oct. 15, 2011.
Zhu, R. et al "The Design of HOA Irregular Decoders Based on the Optimal Symmetrical Virtual Microphone Response" Signal and Information Processing Association Annual Summit and Conference 2014.

* cited by examiner

METHODS, SYSTEMS AND APPARATUS FOR CONVERSION OF SPATIAL AUDIO FORMAT(S) TO SPEAKER SIGNALS

CROSS-REFERENCE TO RELATED APPLICATIONS

This application claims the benefit of priority from U.S. Application No. 62/405,294 filed May 17, 2017 and European Patent Application No. 17170992.6 filed May 15, 2017, which are hereby incorporated by reference in its entirety.

TECHNICAL FIELD

The present disclosure generally relates to playback of audio signals via loudspeakers. In particular, the present disclosure relates to rendering of audio signals in an intermediate (e.g., spatial) signal format, such as audio signals providing a spatial representation of an audio scene.

BACKGROUND

An audio scene may be considered to be an aggregate of one or more component audio signals, each of which is incident at a listener from a respective direction of arrival. For example, some or all component audio signals may correspond to audio objects. For real-world audio scenes, there may be a large number of such component audio signals. Panning an audio signal representing such an audio scene to an array of speakers may impose considerable computational load on the rendering component (e.g., at a decoder) and may consume considerable resources, since panning needs to be performed for each component audio signal individually.

In order to reduce the computational load on the rendering component, the audio signal representing the audio scene may be first panned to an intermediate (e.g., spatial) signal format (intermediate audio format), such as a spatial audio format, that has a predetermined number of components (e.g., channels). Examples of such spatial audio formats include Ambisonics, Higher Order Ambisonics (HOA), and two-dimensional Higher Order Ambisonics (HOA2D). Panning to the intermediate signal format may be referred to as spatial panning. The audio signal in the intermediate signal format can then be rendered to the array of speakers using a rendering operation (i.e., a speaker panning operation).

By this approach, the computational load can be split between the spatial panning operation (e.g., at an encoder) from the audio signal representing the audio scene to the intermediate signal format and the rendering operation (e.g., at the decoder). Since the intermediate signal format has a predetermined (and limited) number of components, rendering to the array of speakers may be computationally inexpensive. On the other hand, the spatial panning from the audio signal representing the audio scene to the intermediate signal format may be perfomed offline, so that computational load is not an issue.

Since the intermediate signal format necessarily has limited spatial resolution (due to its limited number of components), a set of speaker panning functions (i.e., a rendering operation) for rendering the audio signal in the intermediate signal format to the array of speakers that would exactly reproduce direct panning from the audio signal representing the audio scene to the array of speakers does not exist in general, and there is no straightforward approach for determining the speaker panning functions (i.e., the rendering operation). Conventional approaches for determining the speaker panning functions (for a given intermediate signal format and a given speaker array) include heuristic approaches, for example. However, these known approaches suffer from audible artifacts that may result from ripple and/or undershoot of the determined speaker panning functions.

In other words, the creation of a rendering operation (e.g., spatial rendering operation) is a process that is made difficult by the requirement that the resulting speaker signals are intended for a human listener, and hence the quality of the resulting spatial rendering is determined by subjective factors.

Conventional numerical optimization methods are capable of determining the coefficients of a rendering matrix that will provide a high-quality result, when evaluated numerically. A human subject will, however, judge a numerically-optimal spatial renderer to be deficient due to a loss of natural timbre and/or a sense of imprecise image locations.

Thus, there is a need for an alternative method and apparatus for determining the rendering operation for panning an audio signal in an intermediate signal format to an array of speakers and for converting the audio signal in the intermediate signal format to a set of speaker feeds. There is further need for such method and apparatus that avoid undesired audible artifacts.

SUMMARY

In view of this need, the present disclosure proposes a method of converting an audio signal in an intermediate signal format to a set of speaker feeds suitable for playback by an array of speakers, a corresponding apparatus, and a corresponding computer-readable storage medium, having the features of the respective independent claims.

An aspect of the disclosure relates to a method of converting an audio signal (e.g., a multi-component signal or multi-channel signal) in an intermediate signal format (e.g., spatial signal format) to a set of (e.g., two or more) speaker feeds (e.g., speaker signals) suitable for playback by an array of speakers. There may be one such speaker feed per speaker of the array of speakers. The audio signal in the intermediate signal format may be obtainable from an input audio signal (e.g., a multi-component signal or multi-channel input audio signal) by means of a spatial panning function. For example, the audio signal in the intermediate signal format may be obtained by applying the spatial panning function to the input audio signal. The input audio signal may be in any given signal format, such as a signal format different from the intermediate signal format, for example. The spatial panning function may be a panning function that is usable for converting the (or any) input audio signal to the intermediate signal format. Alternatively, the audio signal in the intermediate signal format may be obtained by capturing an audio soundfield (e.g., a real-world audio soundfield) by an appropriate microphone array. In this case, the audio components of the audio signal in the intermediate signal format may appear as if they had been panned by means of a spatial panning function (in other words, spatial panning to the intermediate signal format may occur in the acoustic domain). Obtaining the audio signal in the intermediate signal format may further include post-processing of the captured audio components. The method may include determining a discrete panning function for the array of speakers. For example, the discrete panning function may be a panning function for panning an arbitrary audio signal to the array of speakers. The method may further include determining a target panning function based on (e.g., from) the discrete panning function. Determining the target panning function may involve smoothing the discrete panning function. The method may further include determining a rendering operation (e.g., a linear rendering operation, such as a matrix operation) for converting the audio signal in the intermediate signal format to the set of speaker feeds, based on the target panning function and the spatial panning function. The method may further include applying the rendering operation to the audio signal in the intermediate signal format to generate the set of speaker feeds.

Configured as such, the proposed method allows for an improved conversion from an intermediate signal format to a set of speaker feeds in terms of subjective quality and avoiding of audible artifacts. In particular, a loss of natural timbre and/or a sense of imprecise image locations can be avoided by the proposed method. Thereby, the listener can be provided with a more realistic impression of an original audio scene. To this end, the proposed method provides an (alternative) target panning function, that may not be optimal for direct panning from an input audio signal to the set of speaker feeds, but that yields a superior rendering operation if this target panning function, instead of a conventional direct panning function, is used for determining the rendering operation, e.g., by approximating the target panning function.

In embodiments, the discrete panning function may define, for each of a plurality of directions of arrival, a discrete panning gain for each speaker of the array of speakers. The plurality of directions of arrival may be approximately or substantially evenly distributed directions of arrival, for example on a (unit) sphere or (unit) circle. In general, the plurality of directions of arrival may be directions of arrival contained in a predetermined set of directions of arrival. The directions of arrival may be unit vectors (e.g., on the unit sphere or unit circle). In this case, also the speaker positions may be unit vectors (e.g., on the unit sphere or unit circle).

In embodiments, determining the discrete panning function may involve, for each direction of arrival among the plurality of directions of arrival and for each speaker of the array of speakers, determining the respective discrete panning gain to be equal to zero if the respective direction of arrival is farther from the respective speaker, in terms of a distance function, than from another speaker (i.e., if the respective speaker is not the closest speaker). Said determining the discrete panning function may further involve, for each direction of arrival among the plurality of directions of arrival and for each speaker of the array of speakers, determining the respective discrete panning gain to be equal to a maximum value of the discrete panning function (e.g., value one) if the respective direction of arrival is closer to the respective speaker, in terms of the distance function, than to any other speaker. In other words, for each speaker, the discrete panning gains for those directions of arrival that are closer to that speaker, in terms of the distance function, than to any other speaker may be given by the maximum value of the discrete panning function (e.g., value one), and the discrete panning gains for those directions of arrival that are farther from that speaker, in terms of the distance function, than from another speaker may be given by zero. For each direction of arrival, the discrete panning gains for the speakers of the array of speakers may add up to the maximum value of the discrete panning function, e.g., to one. In case that a direction of arrival has two or more closest speakers (at the same distance), the respective discrete panning gains for the direction of arrival and the two or more closest speakers may be equal to each other and may be given by an integer fraction of the maximum value (e.g., one), so that also in this case a sum of the discrete panning gains for this direction of arrival over the speakers of the array of speakers yields the maximum value (e.g., one). Accordingly, each direction of arrival is 'snapped' to the closest speaker, thereby creating the discrete panning function in a particularly simple and efficient manner.

In embodiments, the discrete panning function may be determined by associating each direction of arrival among the plurality of directions of arrival with a speaker of the array of speakers that is closest (nearest), in terms of a distance function, to that direction of arrival.

In embodiments, a degree of priority may be assigned to each of the speakers of the array of speakers. Further, the distance function between a direction of arrival and a given speaker of the array of speakers may depends on the degree of priority of the given speaker. For example, the distance function may yield smaller distances when a speaker with a higher priority is involved.

Thereby, individual speakers can be given priority over other speakers so that the discrete panning function spans a larger range over which directions of arrival are panned to the individual speakers. Accordingly, panning to speakers that are important for localization of sound objects, such as the left and right front speakers and/or the left and right rear speakers can be enhanced, thereby contributing to a realistic reproduction of the original audio scene.

In embodiments, smoothing the discrete panning function may involve, for each speaker of the array of speakers, for a given direction of arrival, determining a smoothed panning gain for that direction of arrival and for the respective speaker by calculating a weighted sum of the discrete panning gains for the respective speaker for directions of arrival among the plurality of directions of arrival within a window that is centered at the given direction of arrival. Therein, the given direction of arrival is not necessarily a direction of arrival among the plurality of directions of arrival.

In embodiments, a size of the window, for the given direction of arrival, may be determined based on a distance between the given direction of arrival and a closest (nearest) one among the array of speakers. For example, the size of the window may be positively correlated with the distance between the given direction of arrival and the closest (nearest) one among the array of speakers.

The size of the window may be further determined based on a spatial resolution (e.g., angular resolution) of the intermediate signal format. For example, the size of the window may depend on a larger one of said distance and said spatial resolution.

Configured as set out above, the proposed method provides a suitably smooth and well-behaved target panning function so that the resulting rendering operation (that is determined based on the target panning function, e.g., by approximation) is free from ripple and/or undershoot.

In embodiments, calculating the weighted sum may involve, for each of the directions of arrival among the plurality of directions of arrival within the window, determining a weight for the discrete panning gain for the respective speaker and for the respective direction of arrival, based on a distance between the given direction of arrival and the respective direction of arrival.

In embodiments, the weighted sum may be raised to the power of an exponent that is in the range between 0.5 and 1. The range may be an inclusive range. Specific values for the exponent may be given by 0.5, 1, and $1/\sqrt{2}$. Thereby, power compensation of the target panning function (and accordingly, of the rendering operation) can be achieved. For example, by suitable choice of the exponent, the rendering operation can be made to ensure preservation of amplitude (exponent set to 1) or power (exponent set to 0.5).

In embodiments, determining the rendering operation may involve minimizing a difference, in terms of an error function, between an output (e.g., in terms of speaker feeds or panning gains) of a first panning operation that is defined by a combination of the spatial panning function and a candidate for the rendering operation, and an output (e.g., in terms of speaker feeds or panning gains) of a second panning operation that is defined by the target panning function. The eventual rendering operation may be that candidate rendering operation that yields the smallest difference, in terms of the error function.

In embodiments, minimizing said difference may be performed fora set of evenly distributed audio component signal directions (e.g., directions of arrival) as an input to the first and second panning operations. Thereby, it can be ensured that the determined rendering operation is suitable for audio signals in the intermediate signal format obtained from or obtainable from arbitrary input audio signals.

In embodiments, minimizing said difference may be performed in a least squares sense.

In embodiments, the rendering operation may be a matrix operation. In general, the rendering operation may be a linear operation.

In embodiments, determining the rendering operation may involve determining (e.g., selecting) a set of directions of arrival. Determining the rendering operation may further involve determining (e.g., calculating, computing) a spatial panning matrix based on the set of directions of arrival and the spatial panning function (e.g., for the set of directions of arrival). Determining the rendering operation may further involve determining (e.g., calculating, computing) a target panning matrix based on the set of directions of arrival and the target panning function (e.g., for the set of directions or arrival). Determining the rendering operation may further involve determining (e.g., calculating, computing) an inverse or pseudo-inverse of the spatial panning matrix. Determining the rendering operation may further involve determining a matrix representing the rendering operation (e.g., a matrix representation of the rendering operation) based on the target panning matrix and the inverse or pseudo-inverse of the spatial panning matrix. The inverse or pseudo-inverse may be the Moore-Penrose pseudo-inverse. Configured as such, the proposed method provides a convenient implementation of the above minimization scheme.

In embodiments, the intermediate signal format may be a spatial signal format (spatial audio format, spatial format). For example, the intermediate signal format may be one of Ambisonics, Higher Order Ambisonics, or two-dimensional Higher Order Ambisonics.

Spatial signal formats (spatial audio formats, spatial formats) in general and Ambisonics, HOA, and HOA2D in particular are suitable intermediate signal formats for representing a real-world audio scene with a limited number of components or channels. Moreover, designated microphone arrays are available for Ambisonics, HOA, and HOA2D by which a real-world audio soundfield can be captured in order to conveniently generate the audio signal in the Ambisonics, HOA, and HOA2D audio formats, respectively.

Another aspect of the disclosure relates to an apparatus including a processor and a memory coupled to the processor. The memory may store instructions that are executable by the processor. The processor may be configured to perform (e.g., when executing the aforementioned instructions) the method of any one of the aforementioned aspects or embodiments.

Yet another aspect of the disclosure relates to a computer-readable storage medium having stored thereon instructions that, when executed by a processor, cause the processor to perform the method of any one of the aforementioned aspects or embodiments.

It should be noted that the methods and apparatus including its preferred embodiments as outlined in the present document may be used stand-alone or in combination with the other methods and systems disclosed in this document. Furthermore, all aspects of the methods and apparatus outlined in the present document may be arbitrarily combined. In particular, the features of the claims may be combined with one another in an arbitrary manner.

BRIEF DESCRIPTION OF THE DRAWINGS

Example embodiments of the present disclosure are explained below with reference to the accompanying drawings, wherein.

Throughout the drawings, the same or corresponding reference symbols refer to the same or corresponding parts and repeated description thereof may be omitted for reasons of conciseness.

DETAILED DESCRIPTION

Broadly speaking, the present disclosure relates to a method for the conversion of a multichannel spatial-format signal for playback over an array of speakers, utilising a linear operation, such as a matrix operation. The matrix may be chosen so as to match closely to a target panning function (target speaker panning function). The target speaker panning function may be defined by first forming a discrete panning function and then applying smoothing to the discrete panning function. The smoothing may be applied in a manner that varies as a function of direction, dependent on the distance to the closest (nearest) speakers.

Next, the necessary definitions will be given, followed by a detailed description of example embodiments of the present disclosure.

Speaker Panning Functions

An audio scene may be considered to be an aggregate of one or more component audio signals, each of which is incident at a listener from a respective direction of arrival. These audio component signals may correspond to audio objects (audio sources) that may move in space. Let K indicate the number of component audio signals ($K \geq 1$), and for component audio signal k (where $1 \leq k \leq K$), define:

$$\text{Signal: } O_k(t) \in \mathbb{R} \tag{1}$$

$$\text{Direction: } \Phi_k(t) \in S^2 \tag{2}$$

Here, $S^2$ is the common mathematical symbol indicating the unit 2-sphere.

The direction of arrival $\Phi_k(t)$ may be defined as a unit vector $\Phi_k(t)=(x_k(t), y_k(t), z_k(t))$, where $x_k^2(t)+y_k^2(t)+z_k^2(t)=1$. In this case, the audio scene is said to be a 3D audio scene, and allowable direction space is the unit sphere. In some situations, where the component audio signals are constrained in the horizontal plane, it may be assumed that $z_k(t)=0$, and in this case the audio scene will be said to be a 2D audio scene (and $\Phi_k(t) \in S^1$, where $S^1$ defines the 1-sphere, which is also known as the unit circle). In the latter case, the allowable direction space may be the unit circle.

Figure 1:
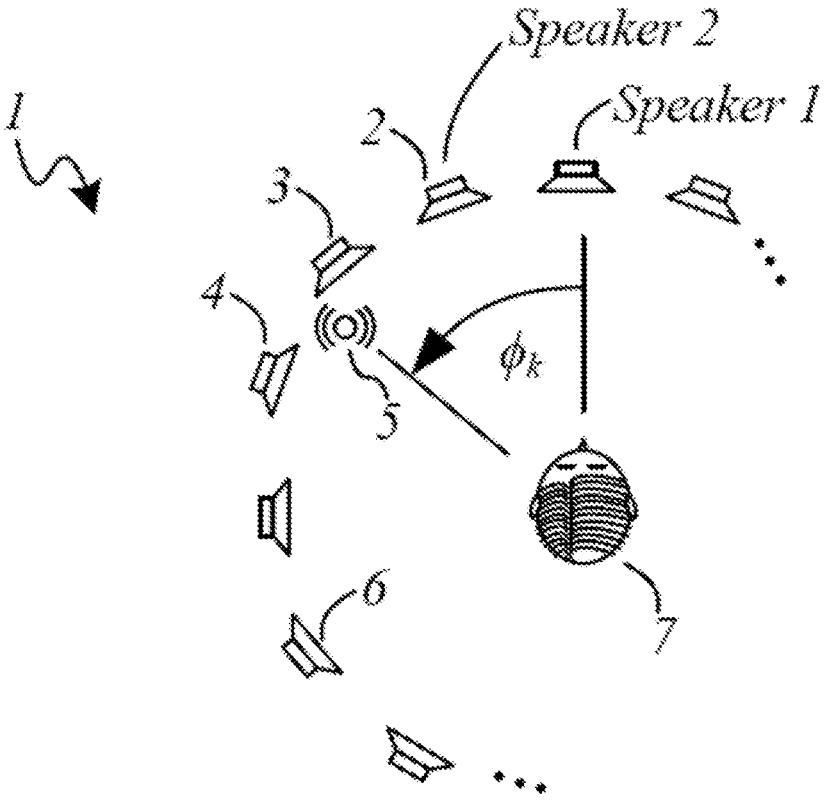
FIG. 1 illustrates an example of locations of speakers (loudspeakers) and an audio object relative to a listener.

FIG. 1 schematically illustrates an example of an arrangement 1 of speakers 2, 3, 4, 6 around a listener 7, in the case where a speaker playback system is intended to provide the listener 7 with the sensation of a component audio signal emanating from a location 5. For example, the desired listener experience can be created by supplying the appropriate signals to the nearby speakers 3 and 4. For simplicity, without intended limitation, FIG. 1 illustrates a speaker arrangement suitable for playback of 2D audio scenes.

The following terms may be defined as:

$$S\text{: The number of speakers} \tag{3}$$

$$s\text{: A particular speaker}(1 \leq s \leq S) \tag{4}$$

$$D'_s(t)\text{: The signal intended for speakers} \tag{5}$$

$$K\text{: The number of component audio signals} \tag{6}$$

$$k\text{: A particular component}(1 \leq k \leq K) \tag{7}$$

Each speaker signal (speaker feed) $D'_s(t)$ may be created as a linear mixture of the component audio signals $O_1(t), \ldots, O_K(t)$:

$$D'_s(t)=\Sigma_{k=1}^{K} g_{k,s}(t) O_k(t) \tag{8}$$

In the above, the coefficients $g_{k,s}(t)$ are possibly time-varying. For convenience, these coefficients may be grouped together into column vectors (one per component audio signal):

$$G_k(t) = \begin{pmatrix} g_{k,1}(t) \\ \vdots \\ g_{k,S}(t) \end{pmatrix} \tag{9}$$

$$= F'(\Phi_k(t)) \tag{10}$$

The coefficients may be determined such that, for each component audio signal, the corresponding gain vector $G_k(t)$ is a function of the direction of the component audio signal $\Phi_k(t)$. The function F'( ) may be referred to as the speaker panning function.

Returning to FIG. 1, the component audio signal k may be located at azimuth angle $\phi_k$ (so that $\Phi_k(t)=(\cos \phi_k, \sin \phi_k, 0)$), and hence the Speaker Panning Function may be used to compute the column vector, $G_k(t)=F'(\Phi_k(t))$.

$G_k(t)$ will be a [S×1] column vector (composed of elements $g_{k,1}(t), \ldots, g_{k,s}(t)$). This panning vector is said to be power-preserving if $\Sigma_{s=1}^{S} g_{k,s}^2(t)=1$, and it is said to be amplitude-preserving if $\Sigma_{s=1}^{S} g_{k,s}(t)=1$.

A power-preserving speaker panning function is desirable when the speaker array is physically large (relative to the wavelength of the audio signals), and an amplitude-preserving speaker panning function is desirable when the speaker array is small (relative to the wavelength of the audio signals).

Different panning coefficients may be applied for different frequency-bands. This may be achieved by a number of methods, including:

- Splitting each component audio signal into multiple sub-band signals and applying different gain coefficients to the different sub-bands, prior to recombining the sub-bands to produce the final speaker signals
- Replacing each of the gain functions (as indicated by the coefficient $g_{k,s}(t)$ in Equation (8)) by filters that provide different gains at different frequencies The extension of the above gain-mixing approach (as per Equation (8)) to a frequency-dependant approach is straightforward, and the methods described in this disclosure may be applied in a frequency-dependant manner using appropriate techniques.

Figure 2:
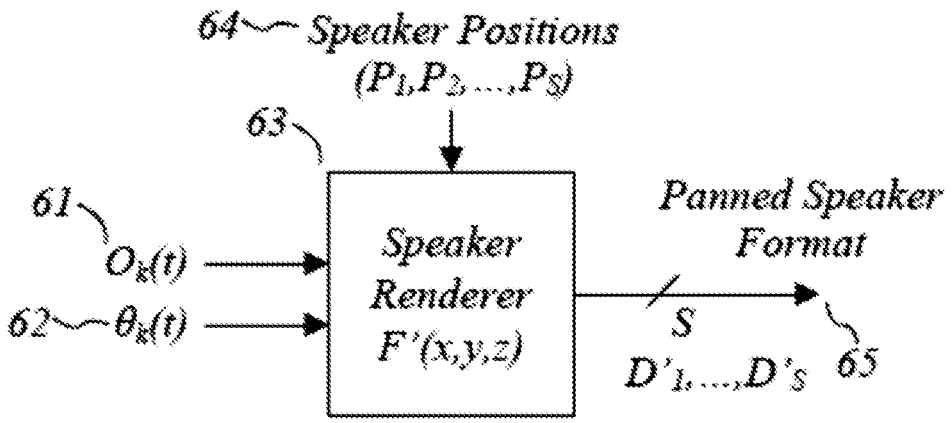
FIG. 2 illustrates an example process for generating speaker feeds (speaker signals) directly from component audio signals.

FIG. 2, which is discussed in more detail below, schematically illustrates an example of the conversion of component audio signal $O_k(t)$ to the speaker signals $D'_1(t), D'_S(t)$.

Spatial Formats

The Speaker Panning Function F'( ) defined in Equation (10) above is determined with regard to the location of the loudspeakers. The speaker s may be located (relative to the listener) in the direction defined by the unit vector $P_S$. In this case, the locations of the speakers ($P_1, \ldots, P_S$) must be known to the speaker panning function (as shown in FIG. 2).

Figure 4:
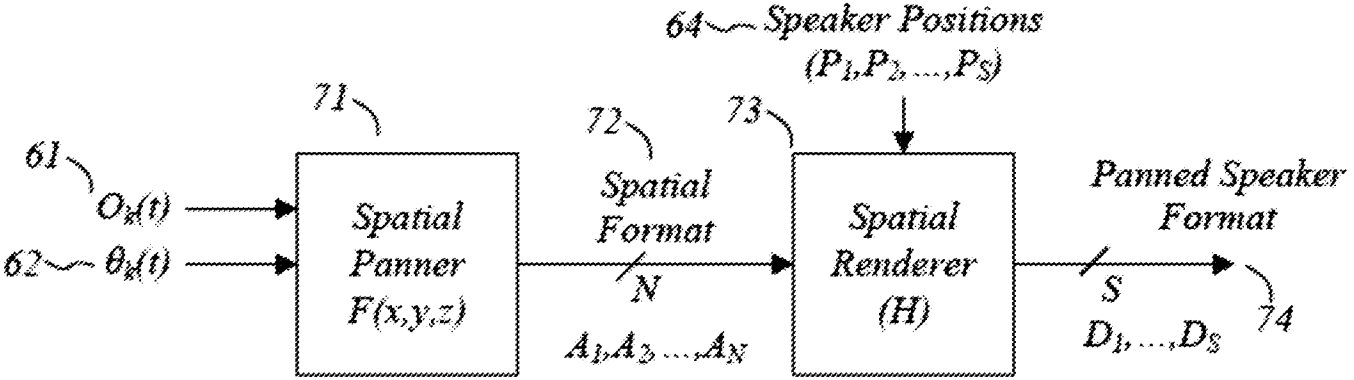
FIG. 4 illustrates an example process for generating a spatial signal from component audio signals and subsequent rendering to speaker signals to which embodiments of the disclosure may be applied.

Alternatively, a spatial panning function F( ) may be defined, such that F( ) is independent of the speaker layout. FIG. 4 schematically illustrates a spatial panner (built using the spatial panning function F( )) that produces a spatial format audio output (e.g., an audio signal in a spatial signal format (spatial audio format) as an example of an intermediate signal format (intermediate audio format)), which is then subsequently rendered (e.g., by a spatial renderer process or spatial rendering operation) to produce the speaker signals ($D_1(t), \ldots, D_S(t)$).

Notably, as shown in FIG. 4, the spatial panner is not provided with knowledge of the speaker positions $P_1, \ldots, P_S$.

Further, the spatial renderer process (which converts the spatial format audio signals into speaker signals) will generally be a fixed matrix (e.g., a fixed matrix specific to the respective intermediate signal format), so that:

$$\begin{pmatrix} D_1(t) \\ \vdots \\ D_S(t) \end{pmatrix} = \begin{pmatrix} h_{1,1} & \ldots & h_{1,N} \\ \vdots & \ddots & \vdots \\ h_{S,1} & \ldots & h_{S,N} \end{pmatrix} \times \begin{pmatrix} A_1(t) \\ \vdots \\ A_N(t) \end{pmatrix} \tag{11}$$

or $$D = H \times A \tag{12}$$

In general, the audio signal in the intermediate signal format may be obtainable from an input audio signal by means of the spatial panning function. This includes the case that the spatial panning is performed in the acoustic domain. That is, the audio signal in the intermediate signal format may be generated by capturing an audio scene using an appropriate array of microphones (the array of microphones may be specific to the descired intermediate signal format). In this case, the spatial panning function may be said to be implemented by the characteristics of the array of microphones that is used for capturing the audio scene. Further, post-processing may be applied to the result of the capture to yield the audio signal in the intermediate signal format.

The present disclosure deals with converting an audio signal in an intermediate signal format (e.g., spatial format) as described above to a set of speaker feeds (speaker signals) suitable for playback by an array of speakers. Examples of intermediate signal formats will be described below. The intermediate signal formats have in common that they have a plurality of component signals (e.g., channels).

In the following, reference will be made, without intended limitation, to a spatial format. It is understood that the present disclosure relates to any kind of intermediate signal format. Further, the expressions intermediate signal format, spatial signal format, spatial format, spatial audio format, etc., may be used interchangeably thoughout the present disclosure, without intended limitation.

Terminology

Several examples of spatial formats (in general, intermediate signal formats) are available, including the following:

Ambisonics is a 4-channel audio format, commonly used to store and transmit audio scenes that have been captured using a multi-capsule soundfield microphone. Ambisonics is defined by the following spatial panning function:

$$F(x, y, z) = \begin{pmatrix} \frac{1}{\sqrt{2}} \\ x \\ y \\ z \end{pmatrix} \tag{13}$$

Higher Order Ambisoncs (HOA) is a multi-channel audio format, commonly used to store and transmit audio scenes with higher spatial resolution, compared to Ambisonics. An L-th order Higher Order Ambisonics spatial format is composed by $(L+1)^2$ channels. Ambisonics is a special case of Higher Order Ambisonics (setting L=1). For example, when L=2, the spatial panning function for HOA is a [9×1] column vector:

$$F(x, y, z) = \begin{pmatrix} 1 \\ \sqrt{3}\,y \\ \sqrt{3}\,x \\ \sqrt{3}\,z \\ \sqrt{15}\,xy \\ \sqrt{15}\,yz \\ \frac{\sqrt{5}}{2}(3z^2 - 1) \\ \sqrt{15}\,xz \\ \frac{\sqrt{15}}{2}(x^2 - y^2) \end{pmatrix} \tag{14}$$

Two-dimensional Higher Order Ambisoncs (HOA2D) is a multi-channel audio format, commonly used to store and transmit 2D audio scenes. An L-th order 2D Higher Order Ambisonics spatial format is composed by 2L+1 channels. For example, when L=3, the spatial panning function for HOA2D is a [7×1] column vector:

$$F(x, y, z) = \begin{pmatrix} 1 \\ \sqrt{2}\,x \\ \sqrt{2}\,y \\ \sqrt{2}\,(x^2 - y^2) \\ 2\sqrt{2}\,xy \\ \sqrt{2}\,(x^3 - 3xy^2) \\ \sqrt{2}\,(3x^2y - y^3) \end{pmatrix} \tag{15}$$

Multiple conventions exist regarding the scaling and the ordering of the components in the HOA panning gain vector. The example in Equation (14) shows the 9 components of the vector arranged in Ambisonic Channel Number ("ACN") order, with the "N3D" scaling convention. The HOA2D example given here makes use of the "N2D" scaling. The terms "ACN", "N3D", and "N2D" are known in the art. Moreover, other orders and conventions are feasible in the context of the present disclosure.

In contrast, the Ambisonics panning function defined in Equation (13) uses the conventional Ambisonics channel ordering and scaling conventions.

In general, any multi-channel (multi-component) audio signal that is generated based on a panning function (such as the function F( ) or F'( ) described herein) is a spatial format. This means that common audio formats such as, for example, Stereo, Pro-Logic Stereo, 5.1, 7.1 or 22.2 (as are known in the art) can be treated as spatial formats.

Spatial formats provide a convenient intermediate signal format, for the storage and transmission of audio scenes. The quality of the audio scene, as it is contained in the spatial format, will generally vary as a function of the number of channels, N, in the spatial format. For example, a 16-channel third-order HOA spatial format signal will support a higher-quality audio scene compared to a 9-channel second-order HOA spatial format signal.

'Quality' may be quantified, as it applies to a spatial format, in terms of a spatial resolution. The spatial resolution may be an angular resolution $Res_A$, to which reference will be made in the following, without intended limitation. Other concepts of spatial resolution are feasible as well in the context of the present disclosure. A higher quality spatial format will be assigned a smaller (in the sense of better) angular resolution, indicating that the spatial format will provide a listener with a rendering of an audio scene with less angular error.

For HOA and HOA2D Formats of order L, $Res_A=360/(2L+1)$, although alternative definitions may also be used.

Speaker Panning Function

FIG. 2 illustrates an example of a process by which each component audio signal $O_k(t)$ can be rendered to the S-channel speaker signals $(D'_1, \ldots, D'_S)$, given that the component audio signal is located at $\Phi_k(t)$ at time t. A speaker renderer 63 operates with knowledge of the speaker positions 64 and creates the panned speaker format signals (speaker feeds) 65 from the input audio signal 61, which is typically a collection of K single-component audio signals (e.g., a monophonic audio signals) and their associated component audio locations (e.g., directions of arrival), for example component audio location 62. FIG. 2 shows this process as it is applied to one component of the input audio signal. In practice, for each of the K component audio signals, the same speaker renderer process will be applied, and the outputs of each process will be summed together:

$$D'(t)=\Sigma_{k=1}^{K}F'(\Phi_k(t))\times O_k(t) \tag{16}$$

Equation (16) says that, at time t, the S-channel audio output 65 of the speaker renderer 63 is represented as D'(t), a [S×1] column vector, and each component audio signal $O_k$ is scaled and summed into this S channel audio output according to the [S×1] column gain vector that is computed by $F'(\Phi_k(t))$.

F'( ) is referred to as the speaker panning function for direct panning of the input audio signal to the speaker signals (speaker feeds). Notably, the speaker panning function F'( ) is defined with knowledge of the speaker positions 64. The intention of the speaker panning function F'( ) is to process the component audio signals (of the input audio signal) to speaker signals so as to ensure that a listener, located at or near the centre of the speaker array, is provided with a listening experience that matches as closely as possible to the original audio scene.

Methods for the design of speaker panning functions are known in the art. Possible implementations include Vector Based Amplitude Panning (VBAP), which is known in the art.

Target Panning Function

The present disclosure seeks to provide a method for determining a rendering operation (e.g., spatial rendering operation) for rendering an audio signal in an intermediate signal format that approximates, when being applied to an audio signal in the intermediate signal format, the result of direct panning from the input audio signal to the speaker signals.

However, instead of attempting to approximate a speaker panning function F'( ) as described above (e.g., a speaker panning function obtained by VBAP), the present disclosure proposes to approximate an alternative panning function F"( ), which will be referred to as the target panning function. In particular, the present disclosure proposes a target panning function for the approximation that has such properties that undesired audible artifacts in the eventual speaker outputs can be reduced or altogether avoided.

Given a direction of arrival $\Phi_k$ the target panning function will compute the target panning gains as a [S×1] column vector $G''=F''(\Phi_k)$.

Figure 5:
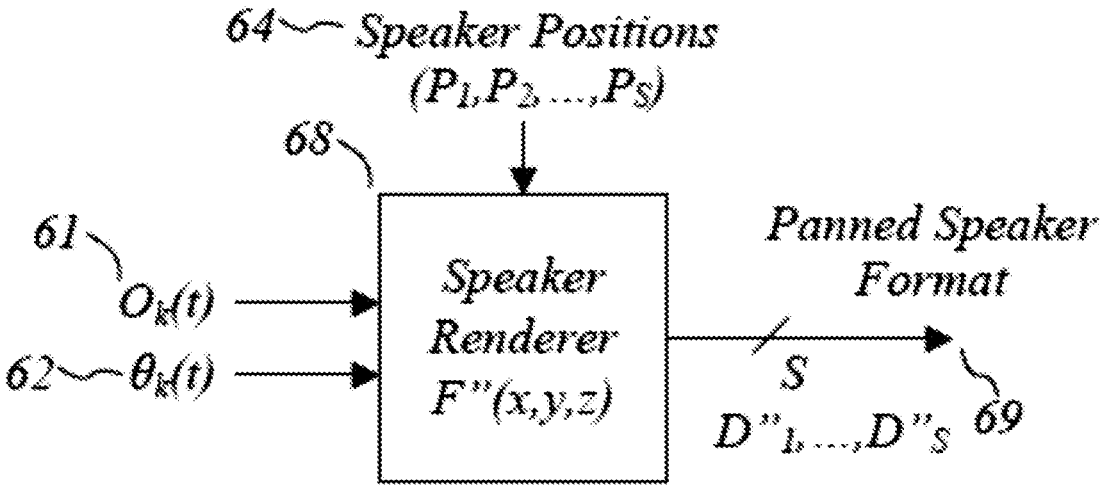
FIG. 5 illustrates an example process for generating speaker feeds (speaker signals) from component audio signals according to embodiments of the disclosure.

FIG. 5 shows an example of a speaker renderer 68 with associated panning function F"( ) (the target panning function). The S-channel output signal 69 of the speaker renderer 68 is denoted $D''_1, \ldots, D''_S$.

This S-channel signal $D''_1, \ldots, D''_S$ is not designed to provide an optimal speaker-playback experience. Instead, the target panning function F"( ) is designed to be a suitable intermediate step towards the implementation of a spatial renderer, as will be described in more detail below.

That is, the target panning function F"( ) is a panning function that is optimized for approximation in determining a spatial panning function (e.g., rendering operation).

Approximating the Target Panning Function Using a Spatial Format

The present disclosure describes a method for approximating the behaviour of the speaker renderer 63 in FIG. 2, by using a spatial format (as an example of an intermediate signal format) as an intermediate signal.

FIG. 4 shows a spatial panner 71 and a spatial renderer 73. The spatial panner 71 operates in a similar manner to the speaker renderer 63 in FIG. 2, with the speaker panning function F'( ) replaced by a spatial panning function F( ):

$$A(t)=\Sigma_{k=1}^{K}F(\Phi_k(t))\times O_k(t) \tag{17}$$

In Equation (17), the spatial panning function F( ) returns a [N×1] column gain vector, so that each component audio signal is panned into the N-channel spatial format signal A. Notably, the spatial panning function F( ) will generally be defined without knowledge of the speaker positions 64.

The spatial renderer 73 performs a rendering operation (e.g., spatial rendering operation) that may be implemented as a linear operation, for example by a linear mixing matrix in accordance with Equation (11). The present disclosure relates to determining this rendering operation. Example embodiments of the present disclosure relate to determining a matrix H that will ensure that the output 74 of the spatial renderer 73 in FIG. 4 is a close match to the output 69 of the speaker renderer 68 (that is based on the target panning function F"( )) in FIG. 5.

The coefficients of a mixing matrix, such as H, may be chosen so as to provide a weighted sum of spatial panning functions that are intended to approximate a target panning function. This is described for example in U.S. Pat. No. 8,103,006, which is hereby incorporated by reference in its entirety, and in which Equation 8 describes the mixing of spatial panning functions in order to approximate a nearest speaker amplitude pan gain curve.

Notably, the family of spherical harmonic functions forms a basis for forming approximations to bounded continuous functions that are defined on the sphere. Furthermore, a finite Fourier series forms a basis for forming approximations to bounded continuous functions that are defined on the circle. The 3D and 2D HOA panning functions are effectively the same as spherical harmonic and Fourier series functions, respectively.

Hence, it is the aim of the methods described below to find the matrix H that provides the best approximation:

$$F''(V_r)\approx H\times F(V_r) \text{ for all } r, 1\leq r\leq R \tag{18}$$

where $V_r$ is a set of directions of arrival (e.g., represented by sample points) on the unit-sphere or unit-circle (for the 3D or 2D cases, respectively).

Figure 13:
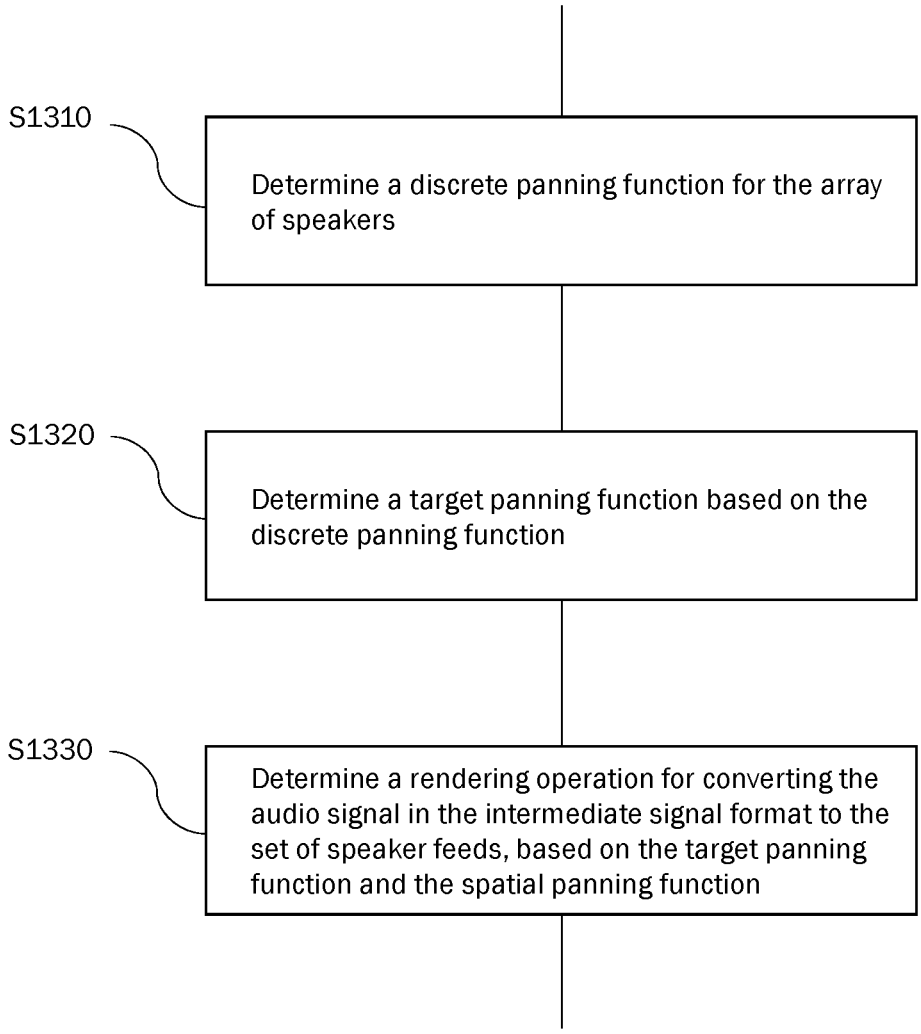
FIG. 13 is a flowchart schematically illustrating an example of a method of converting an audio signal in an intermediate signal format to a set of speaker feeds suitable for playback by an array of speakers according to embodiments of the disclosure.

FIG. 13 schematically illustrates an example of a method of converting an audio signal in an intermediate signal format (e.g., spatial signal format, spatial audio format) to a set of speaker feeds suitable for playback by an array of speakers according to embodiments of the present disclosure. The audio signal in the intermediate signal format may be obtainable from an input audio signal (e.g., a multi-component input audio signal) by means of a spatial panning function, e.g., in the manner described above with reference to Equation (19). Spatial panning (corresponding to the spatial panning function) may also be performed in the acoustic domain by capturing an audio scene with an appropriate array of microphones (e.g., an Ambisonics microphone capsule, etc.).

Figure 15:
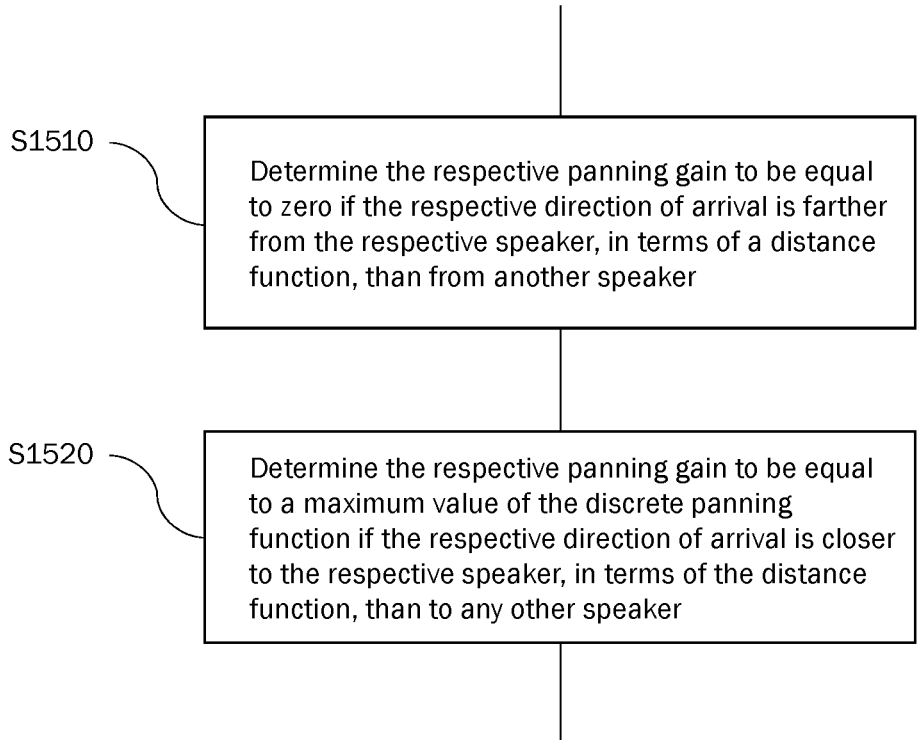
FIG. 15 is a flowchart schematically illustrating an example of details of another step of the method of FIG. 13.

At step S1310 a discrete panning function for the array of speakers is determined. The discrete panning function may be a panning function for panning an input audio signal (defined e.g., by a set of components having respective directions of arrival) to speaker feeds for the array of speakers. The discrete panning function may be discrete in the sense that it defines a discrete panning gain for each speaker of the array of speakers (only) for each of a plurality of directions of arrival. These directions of arrival may be approximately or substantially evenly distributed directions of arrival. In general, the directions of arrival may be contained in a predetermined set of directions of arrival. For the 2D case, the directions of arrival (as well as the positions of the speakers) may be defined (as sample points or unit vectors) on the unit circle $S^1$. For the 3D case, the directions of arrival (as well as the positions of the speakers) may be defined (as sample points or unit vectors) on the unit sphere $S^2$. Methods for determining the discrete panning function will be described in more detail below with reference to FIG. 15 as well as FIG. 6 and FIG. 7.

At step S1320 the target panning function F"( ) is determined based on the discrete panning function. This may involve smoothing the discrete panning function. Methods for determining the target panning function F"( ) will be described in more detail below.

At step S1330 the rendering operation (e.g., matrix operation H) for converting the audio signal in the intermediate signal format to the set of speaker feeds is determined. This determination may be based on the target panning function F"( ) and the spatial panning function F( ). As described above, this determination may involve approximating an output of a panning operation that is defined by the target panning function F"( ), as shown for example in Equation (20). In other words, determining the rendering operation may involve minimizing a difference, in terms of an error function, between an output or result (e.g., in terms of speaker feeds or speaker gains) of a first panning operation that is defined by a combination of the spatial panning function and a candidate for the rendering operation, and an output or result (e.g., in terms of speaker feeds or speaker gains) of a second panning operation that is defined by the target panning function F"( ). For example, minimizing said difference may be performed for a set of audio component signal directions (e.g., evenly distributed audio component signal directions) $\{V_r\}$ as an input to the first and second panning operations.

The method may further include applying the rendering operation determined at step S1330 to the audio signal in the intermediate signal format in order to generate the set of speaker feeds.

The aforementioned approximation (e.g., the aforementioned minimizing of a difference) at step S1330 may be satisfied in a least-squares sense. Hence, the matrix H may be chosen so as to minimize the error function $err=|F''(V_r)-H\times F(V_r)|_F$ (where $|\square|_F$ indicates the Frobenius norm of the matrix). It will also be appreciated that other criteria may be used in determining the error function, which would lead to alternative values of the matrix H.

Figure 14:
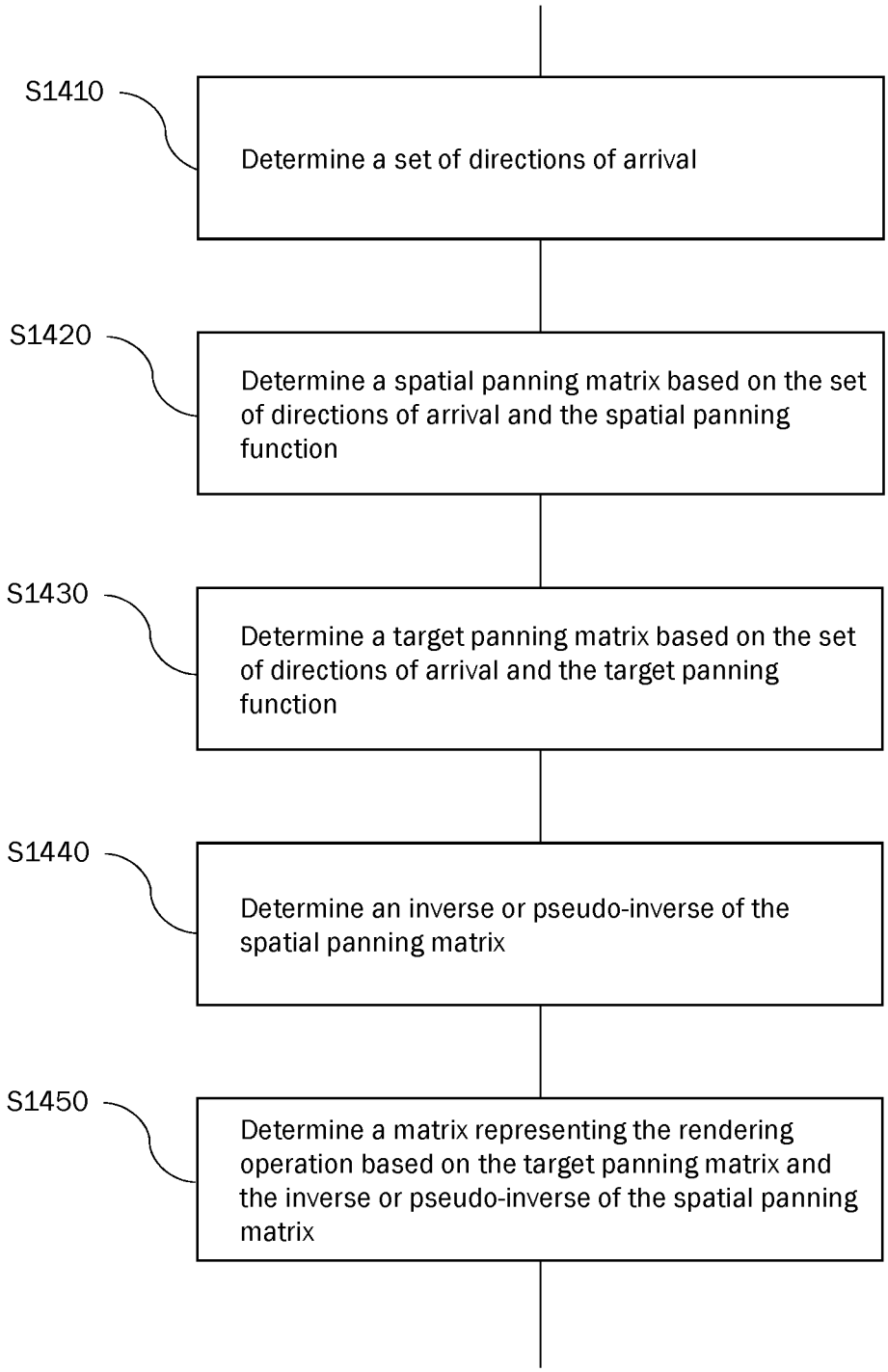
FIG. 14 is a flowchart schematically illustrating an example of details of a step of the method of FIG. 13.

Then, the matrix H may be determined according to the method schematically illustrated in FIG. 14. At step S1410 a set of directions of arrival $\{V_r\}$ are determined (e.g., selected). For example, a set of R direction-of-arrival unit vectors ($V_r$: $1\leq r\leq R$) may be determined. The R direction-of-arrival unit vectors may be approximately uniformly spread over the allowable direction space (e.g., the unit sphere for 3D scenarios or the unit circle for 2D scenarios).

At step S1420 a spatial panning matrix M is determined (e.g., calculated, computed) based on the set of directions of arrival $\{V_r\}$ and the spatial panning function F( ). For example, the spatial panning matrix M may be determined for the set of directions of arrival, using the spatial panning function F( ). That is, a [N×R] spatial panning matrix M may be formed, wherein column r is computed using the spatial panning function F( ), e.g., via $M_r=F(V_r)$. Here, N is the number of signal components of the intermediate signal format, as described above.

At step S1430 a target panning matrix T is determined (e.g., calculated, computed) based on the set of directions of arrival $\{V_r\}$ and the target panning function F"( ). For example, the target panning matrix (target gain matrix) T may be determined for the set of directions of arrival, using the target panning function F"( ). That is, a [S×R] target panning matrix T may be formed, wherein column r is computed using the target panning function F"( ), e.g., via $T_r=F''(V_r)$.

At step S1440 an inverse or pseudo-inverse of the spatial panning matrix M is determined (e.g., calculated, computed). The inverse or pseudo-inverse may be the Moore-Penrose pseudo-inverse, which will be familiar to those skilled in the art.

Finally, at step S1450 the matrix H representing the rendering operation is determined (e.g., calculated, computed) based on the target panning matrix T and the inverse or pseudo-inverse of the spatial panning matrix. For example, H may be computed according to:

$$H=T\times M^{+} \tag{21}$$

In Equation (21), the $\square^{+}$ operator indicates the Moore-Penrose pseudo-inverse. While Equation (21) makes use of the Moore-Penrose pseudo-inverse, also other methods of obtaining an inverse or pseudo-inverse may be used at this stage.

In step S1410, the set of direction-of-arrival unit vectors ($V_r$: $1\leq r\leq R$) may be uniformly spread over the allowable direction space. If the audio scene is a 2D audio scene, the allowable direction space will be the unit circle, and a uniformly sampled set of direction of arrival vectors may be generated, for example, as:

$$V_r=\begin{pmatrix}\cos\frac{2\pi(r-1)}{R}\\ \sin\frac{2\pi(r-1)}{R}\\ 0\end{pmatrix} \tag{22}$$

Further, if the audio scene is a 3D audio scene, the allowable direction space will be the unit sphere, and a number of different methods may be used to generate a set of unit vectors that are approximately uniform in their distribution. One example method is the Monte-Carlo method, by which each unit vector may be chosen randomly. For example, if the operator $\mathcal{N}$ indicates the process for generating a Gaussian distributed random number, then for each r, $V_r$ may be determined according to the following procedure:

1. Determine a vector $tmp_r$ composed on three randomly generated numbers:

$$tmp_r = \begin{pmatrix} \mathcal{N}_{r,1} \\ \mathcal{N}_{r,2} \\ \mathcal{N}_{r,3} \end{pmatrix} \tag{23}$$

2. Determine $V_r$ according to:

$$V_r = \frac{1}{|tmp_r|} \times tmp_r \tag{24}$$

where the |□| operation indicates the 2-norm of a vector, $|v|=\sqrt{v_1^2+v_2^2+v_3^2}$.

It will be appreciated by those skilled in the art that alternative choices may be made for the direction-of-arrival unit vectors ($V_r$: $1 \le r \le R$).

Example Scenario

Next, an example scenario implementing the above method will be described in more detail. In this example, the audio scenes to be rendered are 2D audio scenes, so that the allowable direction space is the unit circle. The number of speakers in the playback environment of this example is S=S. The speakers all lie in the horizontal plane (so they are all at the same elevation as the listening position). The five speakers are located at the following azimuth angles: $P_1$=20°, $P_2$=115°, $P_3$=190°, $P_4$=275° and $P_5$=305°.

Figure 3:
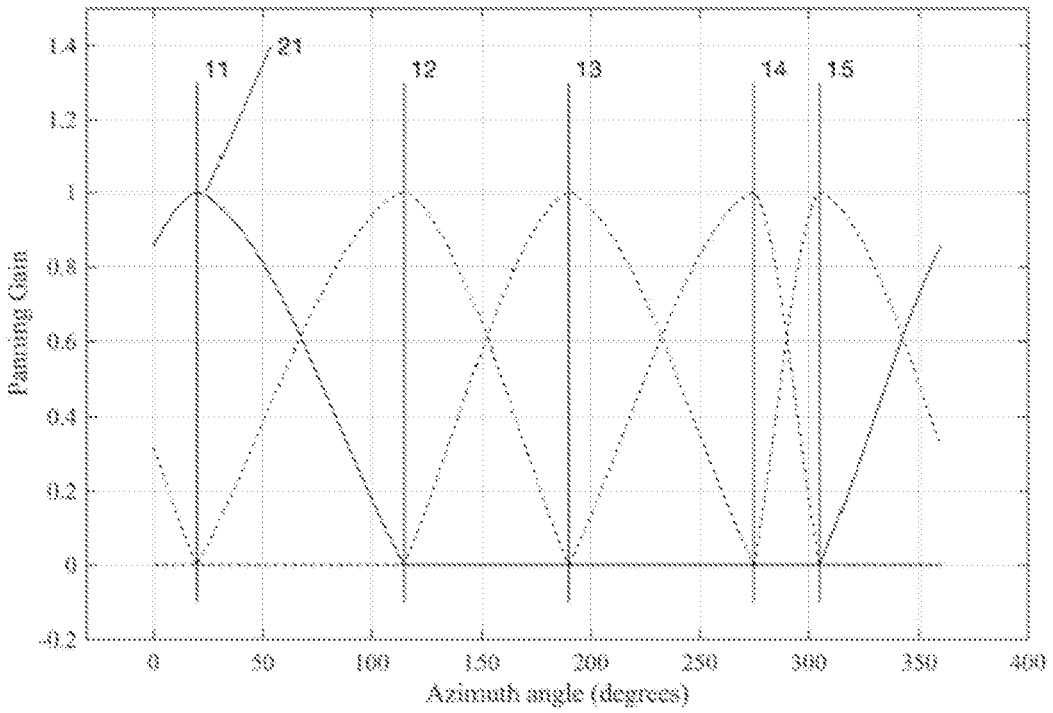
FIG. 3 illustrates an example of the panning gains for a typical speaker panner.

An example of a typical speaker panning function F'( ) as may be used in the system of FIG. 2 is plotted in FIG. 3. This plot illustrates the way a component audio signal is panned to the 5-channel speaker signals (speaker feeds) as the azimuth angle of the component audio signal varies from 0 to 360°. The solid line 21 indicates the gain for speaker 1. The vertical lines indicate the azimuth locations of the speakers, so that line 11 indicates the position of speaker 1, line 12 indicates the position of speaker 2, and so forth. The dashed lines indicate the gains for the other four speakers.

Next, the implementation of a spatial panner and spatial renderer (as per FIG. 4), intended for playback over the above speaker arrangement, will be described. In this example, the spatial panning function F( ) is chosen to be a third-order HOA2D function, as previously defined in Equation (15).

Furthermore, the number of direction-of-arrival vectors (directions of arrival) in this example is chosen to be R=30, with the direction-of-arrival vectors chosen according to Equation (22) (so that the direction-of-arrival vectors correspond to azimuth angles evenly spaced at 12° intervals: 0°, 12°, 24°, . . . , 348°). Hence, the target panning matrix (target gain matrix) T will be a [5×30] matrix.

Having chosen the direction-of-arrival vectors, the [7×30] spatial panning matrix M may be computed, e.g., such that column r is given by $M_r=F(V_r)$.

The target panning matrix T is computed by using the target panning function F"( ). The implementation of this target panning function will be described later.

Figure 10:
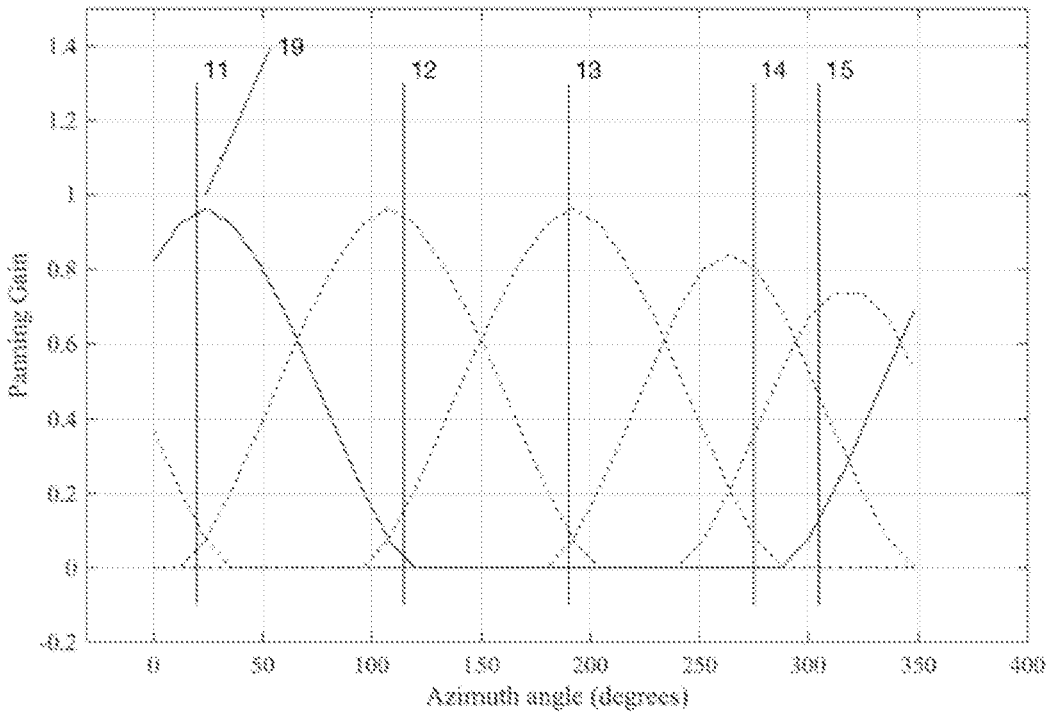
FIG. 10 illustrates an example of power-compensated smoothed panning functions according to embodiments of the disclosure.

FIG. 10 shows plots of the elements of the target panning matrix T in the present example. The [5×30] matrix T is shown as five separate plots, where the horizontal axis corresponds to the azimuth angle of the direction-of-arrival vectors. The solid line 19 indicates the 30 elements in the first row of the target panning matrix T, indicating the target gains for speaker 1. The vertical lines indicate the azimuth locations of the speakers, so that line 11 indicates the position of speaker 1, line 12 indicates the position of speaker 2, and so forth. The dashed lines indicate the 30 elements in the remaining four rows of the target panning matrix T, respectively, indicating the target gains for the remaining four speakers.

Based on the scenario described above, and the chosen values for the [5×30] matrix T, the [5×7] matrix H can be computed to be:

$$H = \begin{pmatrix} 0.273 & 0.284 & 0.127 & 0.101 & 0.112 & 0.008 & 0.025 \\ 0.273 & -0.096 & 0.296 & -0.122 & -0.089 & 0.021 & -0.015 \\ 0.273 & -0.305 & -0.065 & 0.138 & 0.061 & -0.021 & -0.015 \\ 0.206 & -0.026 & -0.247 & -0.145 & 0.031 & 0.016 & 0.049 \\ 0.173 & 0.158 & -0.142 & 0.014 & -0.136 & -0.033 & -0.046 \end{pmatrix} \tag{25}$$

Figure 11:
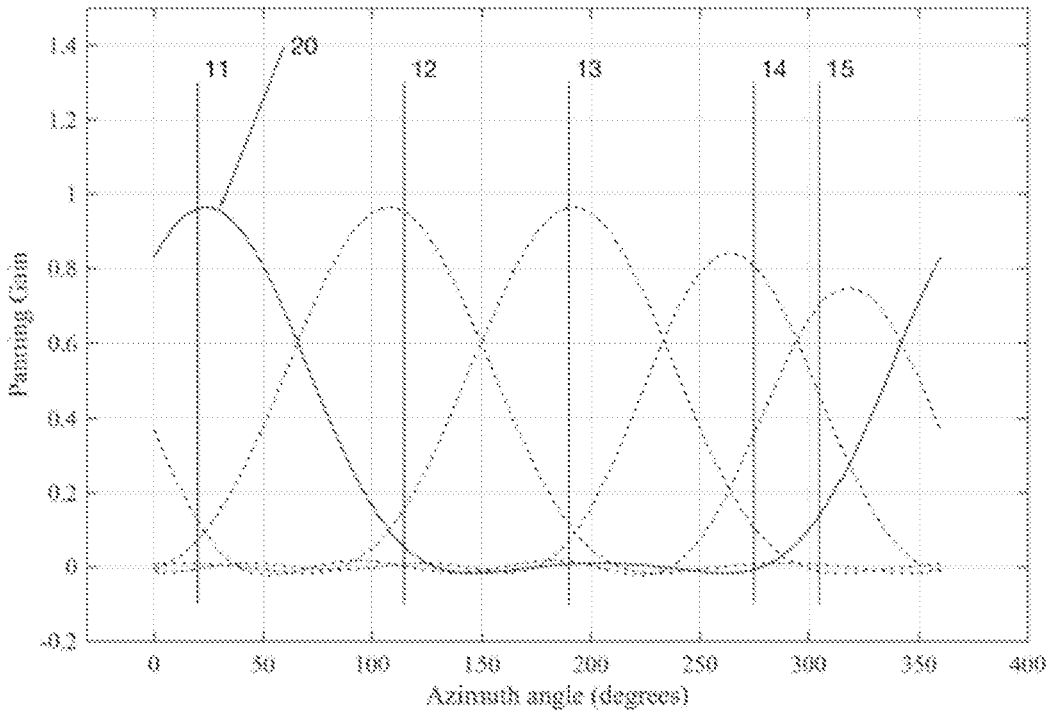
FIG. 11 illustrates an example of the panning functions for component audio signals in an intermediate signal format that are panned to speakers.

Using this matrix H, the total input-to-output panning function for the system shown in FIG. 4 can be determined, for a component audio signal located at any azimuth angle, as shown in FIG. 11. It will be seen that the five curves in this plot are an approximation to the discretely sampled curves in FIG. 10.

The curves shown in FIG. 11 display the following desirable features:

1. The gain curve 20 for the first speaker has its peak gain when the component audio signal is located at approximately the same azimuth angle as the speaker (20° in the example)
2. When a component audio signal is panned to an azimuth angle between 115° and 305° (the locations of the two speakers that are closest to the first speaker), the gain value is close to zero (as indicated by the small ripple in the curve)

These desirable properties of the curves, such as those shown in FIG. 11, result from a careful choice of the target panning function F"( ), as this function is used to generate the target panning matrix (target gain matrix) T. Notably, these desirable properties are not specific to the present example and are, in general, advantages of methods according to embodiments of the present disclosure.

It is important to note that the input-to-output panning functions plotted in FIG. 11 differ from the optimum speaker panning curves shown in FIG. 3. Theoretically, the optimum subjective performance of the spatial renderer would be achieved if it were possible to define a matrix H that ensured that these two plots (FIG. 11 and FIG. 3) were identical.

Unfortunately, the choice of an intermediate signal format (e.g., spatial format) with limited resolution (such as third-order HOA2D in the present example) makes it impossible to achieve a perfect match between the plots of FIG. 11 and FIG. 3. It is tempting to say that, if a perfect match is not possible, then it might be desirable to aim to make these two plots match each other as closely as possible in terms of the least-squares error, $err'=|F'(V_r)-H\times F(V_r)|_F$. However, this would result in undesired audible artifacts that the present disclosure seeks to reduce or altogether avoid.

Thus, the present disclosure proposes to attempt to minimize the error $err=|F''(V_r)-H\times F(V_r)|_F$ rather than attempting to minimise the error $err'=|F'(V_r)-H\times F(V_r)|_F$, as indicated above.

In other words, the present disclosure proposes to implement a spatial renderer based on a rendering operation (e.g., implemented by matrix H) that is chosen to emulate the target panning function F"( ) rather than the speaker panning function F'( ). The intention of the target panning function F"( ) is to provide a target for the creation of the rendering operation (e.g., matrix H), such that the overall input-to-output panning function achieved by the spatial panner and spatial renderer (as, e.g., shown in FIG. 4) will provide a superior subjective listening experience.

Determination of the Target Panning Function

As described above with reference to FIG. 13, methods according to embodiments of the disclosure serve to create a superior matrix H by first determining a particular target panning function F"( ).

To this end, at step S1310, a discrete panning function is determined. Determination of the discrete panning function will be described next, partially with reference to FIG. 15.

As indicated above, the discrete panning function defines a (discrete) panning gain for each of a plurality of directions of arrival (e.g., a predetermined set of directions of arrival) and for each of the speakers of the array of speakers. In this sense, the discrete panning function may be represented, without intended limitation, by a discrete panning matrix J.

The discrete panning matrix J may be determined as follows:

1. Determine a plurality of directions of arrival. The plurality of directions of arrival may be represented by a set of Q directions of arrival (direction-of-arrival unit vectors; $W_q$: $1\leq q\leq Q$). The Q direction-of-arrival unit vectors may be approximately uniformly spread over the allowable direction space (e.g., the unit sphere or the unit circle). This process is similar to the process used to generate the direction-of-arrival vectors, ($V_r$: $1\leq r\leq R$) at step S1410 in FIG. 14. In embodiments, Q=R and $Q_r=V_r$ for all $1\leq r\leq R$ may be set.
2. Define an array J as a [S×Q] array. Initially, set all S×Q elements of this array to zero.
3. The elements (discrete panning gains) of the array J are then determined according to the method of FIG. 15, the steps of which are performed for each entry of the array J, i.e., for each of the Q directions of arrival and for each of the speakers.

At step S1510 it is determined whether the respective direction of arrival is farther from the respective speaker, in terms of a distance function, than from another speaker (i.e., if there is any speaker that is closer to the respective direction of arrival than the respective speaker). If so, the respective discrete panning gain is determined to be zero (i.e., is set to zero or retained at zero). In case that the elements of array J are initialized to zero, as indicated above, this step may be omitted.

At step S1520 it is determined whether the respective direction of arrival is closer to the respective speaker, in terms of the distance function, than to any other speaker. If so, the respective discrete panning gain is determined to be equal to a maximum value of the discrete panning function (i.e., is set to that value). The maximum value of the discrete panning function (e.g., the maximum value for the entries of the array J) may be one (1), for example.

In other words, for each speaker, the discrete panning gains for those directions of arrival that are closer to that speaker, in terms of the distance function, than to any other speaker may be set to said maximum value. On the other hand, the discrete panning gains for those directions of arrival that are farther from that speaker, in terms of the distance function, than from another speaker may be set to zero or retained at zero. For each direction of arrival, the discrete panning gains, when summed over the speakers, may add up to the maximum value of the discrete panning function, e.g., to one.

In case that a direction of arrival has two or more closest (nearest) speakers (at the same distance), the respective discrete panning gains for the direction of arrival and the two or more closest speakers may be equal to each other and may be an integer fraction of the maximum value of the discrete panning function. Then, also in this case a sum of the discrete panning gains for this direction of arrival over the speakers of the array of speakers yields the maximum value (e.g., one).

The above steps amount to the following processing that is performed for each direction of arrival q (where $1\leq q\leq Q$):

(a) Determine the distance of each speaker from the point $W_q$, according to the distance function $dist_s=d(P_s, W_q)$. Without intended limitation, the distance function d( ) may be defined as $d(v_1, v_2)=\cos^{-1}(v_1^T\times v_2)$, which is the angle between the two unit vectors. Other definitions of the distance function d( ) are feasible as well in the context of the present disclosure. For example, any metric on the allowable direction space may be chosen as the distance function d( ).

(b) Determine the set of speakers that are closest to the point $W_q$, as $$\hat{s}=\text{argmin}_s dist_s \tag{24}$$

and for each speaker $s\in\hat{s}$, set $J_{s,q}=1/m$, where m is the number of elements in the set $\hat{s}$.

The resulting matrix J will be sparse (with most entries in the matrix being zero) such that the elements in each column add to 1 (as an example of the maximum value of the discrete panning function).

Figure 6:
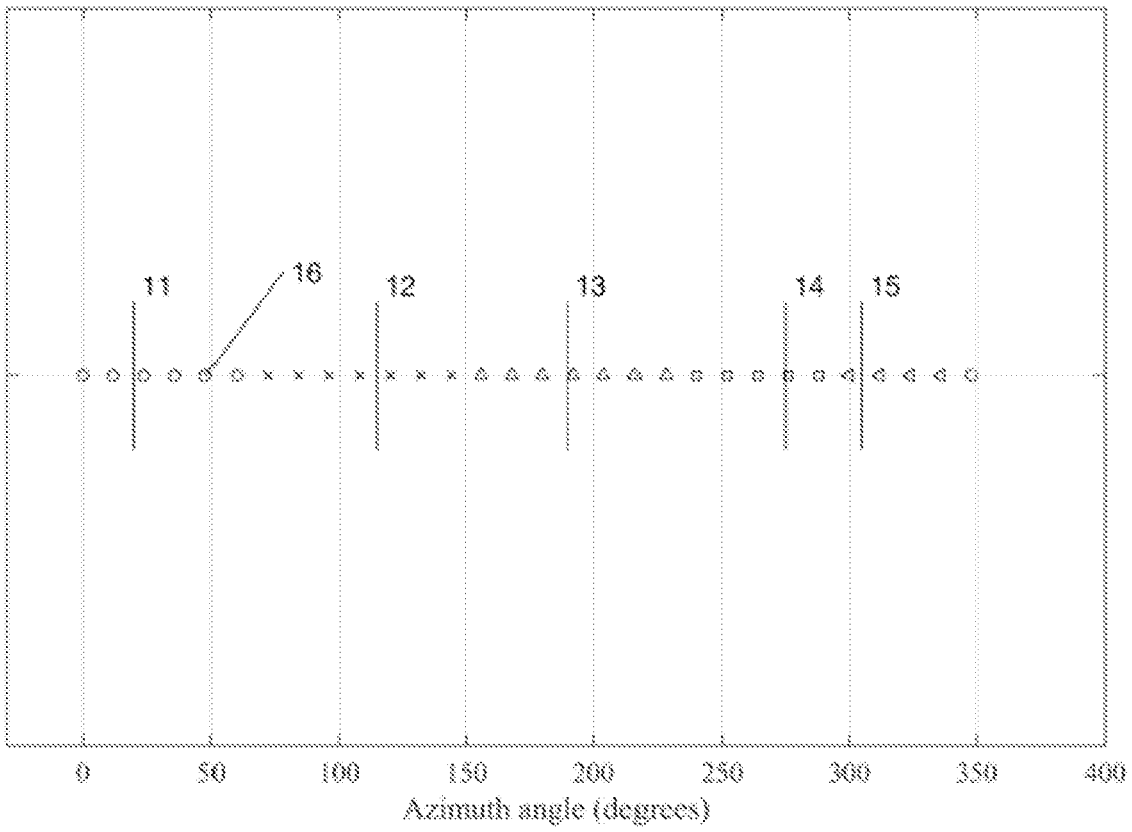
FIG. 6 illustrates an example of an allocation of sampled directions of arrival to respective nearest speakers according to embodiments of the disclosure.

FIG. 6 illustrates the process by which each direction-of-arrival unit vector $W_q$ is allocated to a 'nearest speaker'. In FIG. 6, the direction-of-arrival unit vector 16 (which is located at an azimuth angle of 48°) for example is tagged with a circle, indicating that it is nearest to the first speaker's azimuth 11.

Thus, as can be seen from FIG. 6, the discrete panning function is determined by associating each direction of arrival among the plurality of directions of arrival with a speaker of the array of speakers that is closest (nearest), in terms of the distance function, to that direction of arrival.

Figure 7:
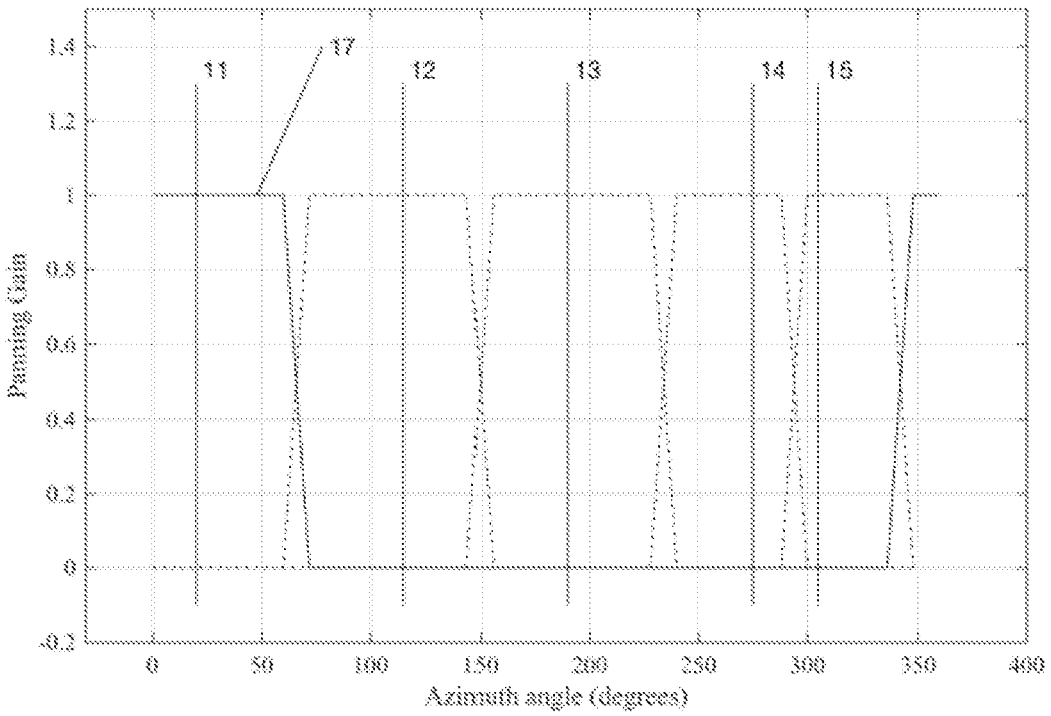
FIG. 7 illustrates an example of discrete panning functions resulting from the allocation of FIG. 6 according to embodiments of the disclosure.

FIG. 7 shows a plot of the matrix J. The sparseness of J is evident in the shape of these curves (with most curves taking on the value zero at most azimuth angles).

As described above, the target panning function F"( ) is determined based on the discrete panning function at step S1320 by smoothing the discrete panning function. Smoothing the discrete panning function may involve, for each speakers of the array of speakers, for a given direction of arrival Φ, determining a smoothed panning gain $G_s$ for that direction of arrival Φ and for the respective speaker s by calculating a weighted sum of the discrete panning gains $J_{s,q}$ for the respective speaker s for directions of arrival $W_q$ among the plurality of directions of arrival within a window that is centered at the given direction of arrival Φ. Here, the given direction of arrival Φ is not necessarily a direction of arrival among the plurality of directions of arrival $\{W_q\}$. In other words, smoothing the discrete panning function may also involve an interpolation between directions of arrival q.

In the above, a size of the window, for the given direction of arrival Φ, may be determined based on a distance between the given direction of arrival Φ and a closest (nearest) one among the array of speakers. For example, a distance (e.g., angular distance) $AP_s$ of the given direction of arrival Φ from each of the speakers may be determined according to $AP_s=d(P_s, \Phi)$. Then, the distance between the given direction of arrival Φ and the closest (nearest) one among the array of speakers may be given by a quantity SpeakerNearness=min($AP_s$, s=1 . . . S). The size of the window may be positively correlated with the distance between the given direction of arrival Φ and the closest (nearest) one among the array of speakers. Further, the spatial resolution (e.g., angular resolution) of the intermediate signal format in question may be taken into account when determining the size of the window. For example, for HOA and HOA2D spatial formats of order L, the agular resolution (as an example of the spatial resolution) may be defined as $Res_A=360/(2L+1)$. Other definitions of the spatial resolution are feasible as well in the context of the present disclosure. In general, the spatial resolution may be negatively (e.g., inversely) correlated with the number of components (e.g., channels) of the intermediate signal format (e.g., 2L+1 for HOA2D). When taking into account the spatial resolution, the size of the window may depend on (e.g., may be positively correlated with) a larger one of the distance between the given direction of arrival Φ and the closest (nearest) one among the array of speakers and the spatial resolution. That is, the size of the window may depend on (e.g., may be positively correlated with) a quantity Spread Angle=max($Res_A$, SpeakerNearness). Accordingly, the window is larger if the given direction of arrival is farther from a closests (nearest) speaker. The spatial resolution provides a lower bound on the size of the window to ensure smoothness and well-behaved approximation of the smoothed panning function (i.e., the target panning function).

Further in the above, calculating the weighted sum may involve, for each of the directions of arrival q among the plurality of directions of arrival within the window, determining a weight $w_q$ for the discrete panning gain $J_{s,q}$ for the respective speakers and for the respective direction of arrival q, based on a distance between the given direction of arrival Φ and the respective direction of arrival q. Without intended limitation, this distance may be an angular distance, e.g., defined as $AQ_q=d(W_q, \Phi)$. For example, the weight $w_q$ may be negatively (e.g., inversely) correlated with the distance between the given direction of arrival Φ and the respective direction of arrival q. That is, discrete panning gains $J_{s,q}$ for directions of arrival q that are closer to the given direction of arrival Φ will have a larger weight $w_q$ than discrete panning gains $J_{s,q}$ for directions of arrival q that are farther from the given direction of arrival Φ.

Yet further in the above, the weighted sum may be raised to the power of an exponent p that is in the range between 0.5 and 1. Thereby, power compensation of the smoothed panning function (i.e., the target panning function) may be performed. The range for the exponent p may be an inclusive range. Specific values for the exponent p are 0.5 and 1. Setting p=1 ensures that the smoothed panning function is amplitude preserving. Setting p=½ ensures that the smoothed panning function is power preserving.

An example process flow implementing the above prescription for smoothing the discrete panning function and for obtaining the target panning function F"( ) will be described next. Given a unit vector Φ (representing the given direction of arrival) as input, the [S×1] column vector G to be returned by this function, as follows:

1. Determine the angular distance of the unit vector Φ from each of the direction-of-arrival unit vectors ($W_q$: 1≤q≤Q), according to $AQ_q=d(W_q, \Phi)$
2. Determine the angular distance of the unit vector Φ from each of the speakers of the array of speakers according to $AP_s=d(P_s, \Phi)$
3. Determine the SpeakerNearness according to SpeakerNearness=min($AP_s$, s=1 . . . S)
4. Determine the SpreadAngle according to:

$$\text{SpreadAngle}=\max(\text{Res}_A,\text{SpeakerNearness}) \tag{25}$$

5. Now, for each direction-of-arrival unit vector (i.e., for each direction of arrival among the plurality of directions of arrival) q, where 1≤q≤Q, determine a weighting (i.e., a weight) according to:

$$w_q = \begin{cases} 0 & AQ_q \geq SpreadAngle \\ \text{window}\left(\dfrac{AQ_q}{SpreadAngle}\right) & AQ_q < SpreadAngle \end{cases} \tag{26}$$

where window(α) may be a monotonic decreasing function, e.g., a monotonic decreasing function taking values between 1 and 0 for allowable values of its argument. For example, $$\text{window}(\alpha) = \cos\frac{\pi\alpha}{2}$$

may be chosen.

6. The column vector G can now be computed as:

$$G_s=(\Sigma_{q=1}^{Q} w_q)^{-p}\times(\Sigma_{q=1}^{Q} w_q J_{s,q})^p \tag{27}$$

The process above effectively computes the 'smoothed' gain values G=F"(Φ) from the 'discrete' set of gain values J.

Figure 8:
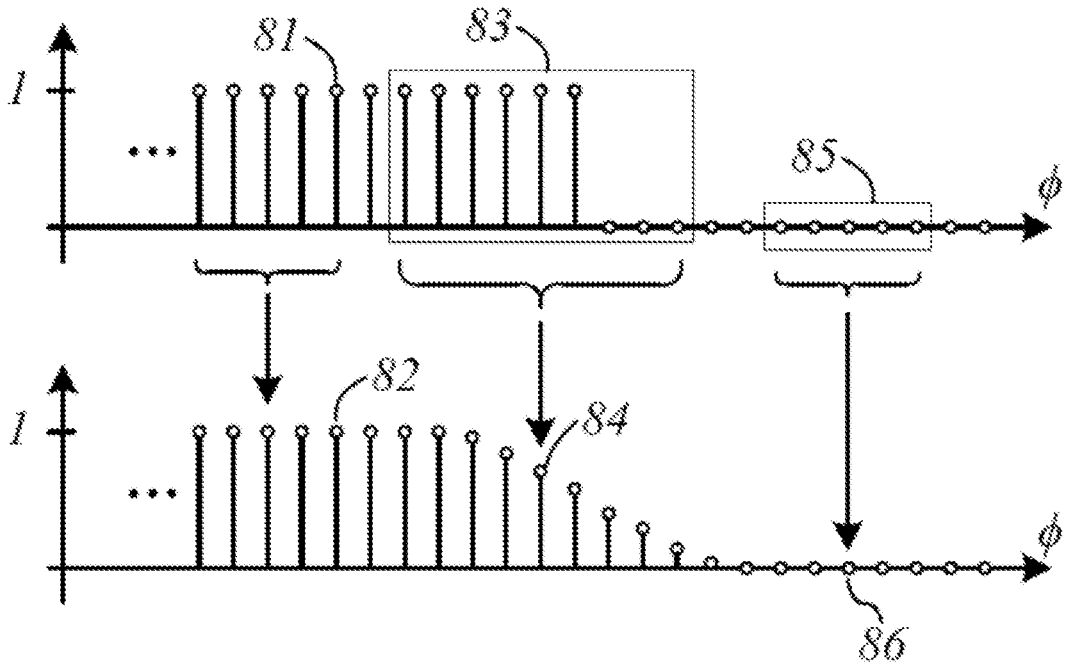
FIG. 8 illustrates an example of a method of creating a smoothed panning function from a discrete panning function according to embodiments of the disclosure.

An example of the smoothing process is shown in FIG. 8, whereby a smoothed gain value (smoothed panning gain) 84 is computed from a weighted sum of discrete gains values (discrete panning gains) 83. Likewise, a smoothed gain value (smoothed panning gain) 86 is computed from a weighted sum of discrete gains values (discrete panning gains) 85.

As indicated above, the smoothing process makes use of a 'window' and the size of this window will vary, depending on the given direction of arrival Φ. For example, in FIG. 8, the SpreadAngle that is computed for the calculation of smoothed gain value 84 is larger than the SpreadAngle that is computed for the calculation of smoothed gain value 86, and this is reflected in the difference in the size of the spanning boxes (windows) 83 and 85, respectively. That is, the window for computing the smoothed gain value 84 is larger than the window for computing the smoothed gain value 86.

In other words, the SpreadAngle will be smaller when the given direction of arrival Φ is close to one or more speakers, and will be larger when the given direction of arrival Φ is further from all speakers.

Figure 9:
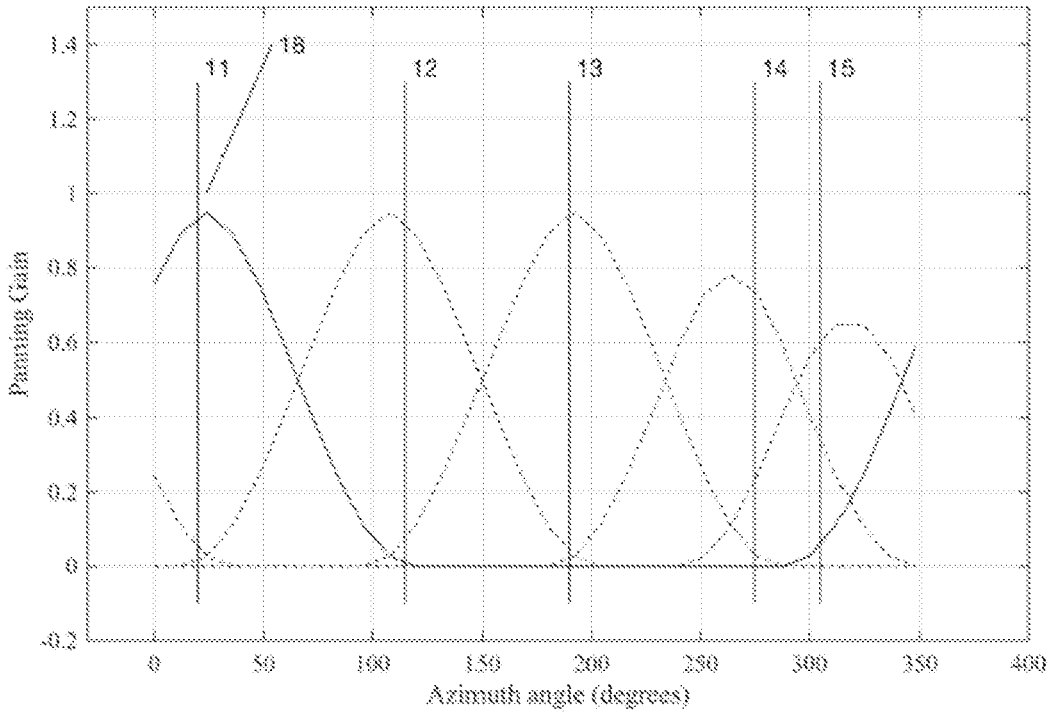
FIG. 9 illustrates an example of smoothed panning functions according to embodiments of the disclosure.

The power-factor (exponent) p used in Equation (27) may be set to p=1 to ensure that the resulting gain vector (e.g., the resulting target panning function) is amplitude preserving, so that $\Sigma_{s=1}^{S} G_s=1$. The resulting gain values are plotted in FIG. 9. On the other hand, the power factor may be set to p=½ to ensure that the resulting gain vector is power preserving, so that $\Sigma_{s=1}^{S} G_s^2=1$. In general, the value of the power-factor p may be set to a value between p=½ and p=1. the power-factor may also be set to an intermediate value between ½ and 1, such as $p=1/\sqrt{2}$, for example. The resulting gain values for this choice of the power-factor are plotted in FIG. 10.

Modification of the Distance Function

In the procedure for computing the discrete panning matrix J, a distance function d( ) was used to determine the distance of a direction of arrival (e.g., a unit vector $W_q$) from each speaker, $dist_s=d(P_s, W_q)$.

This distance function may be modified by allocating (e.g., assigning) a priority (e.g., a degree of priority) $c_s$ to each speaker. For example, one may assign a priority (e.g., a degree of priority) $c_s$, where $0 \le c_s \le 4$. If $c_s=0$, the corresponding speaker is not given priority over others, whereas $c_s=4$ indicates the highest priority. If priorities are assigned, the distance function between a direction of arrival and a given speaker of the array of speakers may also depend on the degree of priority of the given speaker. The priority-biased distance calculation then may become $dist_s=d_p(P_s, W_q, c_s)$.

For example, the front-left and front-right speakers (the symmetric pair with their azimuth angles closest to +30° and −30° respectively), if they exist, may be assigned the highest priority $c_s$ (e.g., priority $c_s=4$). Furthermore, the left-rear and right rear speakers (the symmetric pair with their azimuth angles closest to +130° and −130° respectively), if they exist, may also be assigned the highest priority (e.g., priority $c_s=4$). Finally, the center speaker (the speaker with azimuth 0°), if it exists, may be assigned an intermediate priority (e.g., priority $c_s=2$). All other speakers may be assigned no priority (e.g., priority $c_s=0$).

Recalling that the unbiased-distance function may bedefined as, for example, $d(v_1, v_2)=\cos^{-1}(v_1^T \times v_2)$, the biased (modified) version may be defined as, for example:

$$d_p(v_1, v_2, c) = \begin{cases} d(v_1, v_2) & \text{for } d(v_1, v_2) \ge Res_A \\ d(v_1, v_2)\left(\frac{d(v_1, v_2)}{Res_A}\right)^{c_s} & \text{for } d(v_1, v_2) < Res_A \end{cases} \quad (28)$$

The use of the biased (modified) distance function $d_p$( ) effectively means that when the direction of arrival (unit vector) $W_q$ is close to multiple speakers, the speaker with a higher priority may be chosen as the 'nearest speaker', even though it may be farther away. This will alter the discrete panning array J so that the panning functions for higher priority speakers will span a larger angular range (e.g., will have a larger range over which the discrete panning gains are non-zero).

Extension to 3D

Some of the examples given above show the behaviour of the spatial renderer when the audio scene is a 2D audio scene. The use of a 2D audio scene for these examples has been chosen in order to simplify the explanation, as it makes the plots more easily interpreted. However, the present disclosure is equally applicable to 3D audio scenes, with appropriately defined distance functions, etc. An example of the 'nearest speaker' allocation process for the 3D case is shown in FIG. 12.

Figure 12:
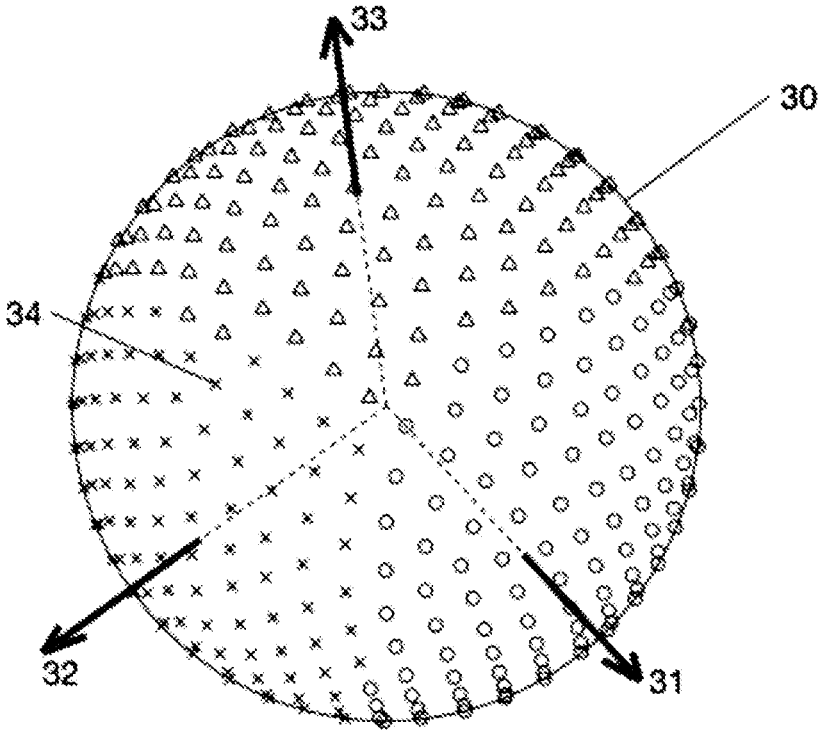
FIG. 12 illustrates an example of an allocation of sampled directions of arrival on a sphere to respective nearest speakers of a 3D speaker array according to embodiments of the disclosure.

In FIG. 12, the Q direction-of-arrival unit vectors, for example direction of arrival (unit vector) 34 are shown scattered (approximately) evenly over the surface of the unit-sphere 30. Three speaker directions are indicated as 31, 32, and 33. The direction-of-arrival unit vector 34 is marked with an 'x' symbol, indicating that it is closest to the speaker direction 32. In a similar fashion, all direction-of-arrival unit vectors are marked with a triangle, a cross or a circle, indicating their respective closest speaker direction.

FURTHER ADVANTAGES

The creation of a rendering operation (e.g., spatial rendering operation), for example of spatial renderer matrices (such as H in the example of Equation (8)) is a process that is made difficult by the requirement that the resulting speaker signals are intended for a human listener, and hence the quality of the resulting Spatial Renderer is determined by subjective factors.

Many conventional numerical optimization methods are capable of determining the coefficients of a matrix H that will provide a high-quality result, when evaluated numerically. A human subject will, however, judge a numerically-optimal spatial renderer to be deficient due to a loss of natural timbre and/or a sense of imprecise image locations.

The methods presented in this disclosure define a target panning function F"( ) that is not necessarily intended to provide optimum playback quality for direct rendering to speakers, but instead provides an improved subjective playback quality for a spatial renderer, when the spatial renderer is designed to approximate the target panning function.

It will be appreciated that the the methods described herein may be widely applicable and may also be applied to, for example:

- audio processing systems that operate on the audio signals in multiple frequency bands (such as frequency-domain processes)
- alternative soundfield formats (other than HOA) as may be defined for various use cases Various example embodiments of the present invention may be implemented in hardware or special purpose circuits, software, logic or any combination thereof. Some aspects may be implemented in hardware, while other aspects may be implemented in firmware or software, which may be executed by a controller, microprocessor or other computing device. In general, the present disclosure is understood to also encompass an apparatus suitable for performing the methods described above, for example an apparatus (spatial renderer) having a memory and a processor coupled to the memory, wherein the processor is configured to execute instructions and to perform methods according to embodiments of the disclosure.

While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller, or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine-readable medium, in which the computer program containing program codes configured to carry out the methods as described above.

In the context of the disclosure, a machine-readable medium may be any tangible medium that may contain, or store, a program for use by or in connection with an instruction execution system, apparatus, or device. The machine-readable medium may be a machine-readable signal medium or a machine-readable storage medium. A machine-readable medium may include but is not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention, or of what may be claimed, but rather as descriptions of features that may be specific to particular embodiments of particular inventions. Certain features that are described in this specification in the context of separate embodiments may also may be implemented in combination in a single embodiment. Conversely, various features that are described in the context of a single embodiment may also may be implemented in multiple embodiments separately or in any suitable sub-combination.

It should be noted that the description and drawings merely illustrate the principles of the proposed methods and apparatus. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and apparatus and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Enumerated exemplary embodiments of the disclosure relate to:

EEE1: A method for converting a spatial format signal to a set of two or more speaker signals, suitable for playback to an array of speakers, the method consisting of a matrix operation wherein: (a) said spatial format signal is defined in terms of a multi-channel spatial panning function applied to one or more component audio signals, (b) the coefficients of said matrix are chosen so as to minimise the difference between the said speaker signals and the target speaker signals that would be produced by a target panning function applied to said component audio signals, and (c) the said target panning function is defined by applying a smoothing operation to a discrete panning function.

EEE2: The method of EEE1, wherein the said discrete panning function is approximately an indicator function that associates each direction-of-arrival with the nearest speaker in said array of speakers.

EEE3: The method of EEE2, wherein the determination of said nearest speaker is modified by biasing the distance estimation to reduce the estimated distance associated with speakers that are assigned with higher priority.

EEE4: The method of EEE1 or EEE2 or EEE3, wherein the said smoothing operation forms a weighted sum of said discrete panning function values, evaluated over a range of smoothing directions, wherein the extent of said range of smoothing directions is varied as a function of the direction of said component audio signal, and such that the extend of said range is larger when the said direction of said component audio signal is further from the nearest speaker in said array of speakers.

EEE5: The method of EEE4, wherein the said weighted sum is modified by being raised to the power of an exponent that lies in the range between 0.5 and 1.

EEE6: The method of any one of EEE1 to EEE5, wherein the said minimisation is performed in least squares sense.

EEE7: The method of EEE6, wherein the said minimisation is performed for a set of audio component signal directions that are distributed approximately evenly over an allowable direction space, said allowable direction space representing the region within which the subjective performance of the said matrix operation is to be optimised.

EEE 8: A method of converting an audio signal in an intermediate signal format to a set of speaker feeds suitable for playback by an array of speakers, wherein the audio signal in the intermediate signal format is obtainable from an input audio signal by means of a spatial panning function, the method comprising:

determining a discrete panning function for the array of speakers;

determining a target panning function based on the discrete panning function, wherein determining the target panning function involves smoothing the discrete panning function; and determining a rendering operation for converting the audio signal in the intermediate signal format to the set of speaker feeds, based on the target panning function and the spatial panning function.

EEE 9: The method according to EEE 8, wherein the discrete panning function defines, for each of a plurality of directions of arrival, a discrete panning gain for each speaker of the array of speakers.

EEE 10: The method according to EEE 9, wherein determining the discrete panning function involves, for each direction of arrival and for each speaker of the array of speakers:

determining the respective panning gain to be equal to zero if the respective direction of arrival is farther from the respective speaker, in terms of a distance function, than from another speaker; and determining the respective panning gain to be equal to a maximum value of the discrete panning function if the respective direction of arrival is closer to the respective speaker, in terms of the distance function, than to any other speaker.

EEE 11: The method according to EEE 9 or 10, wherein the discrete panning function is determined by associating each direction of arrival with a speaker of the array of speakers that is closest, in terms of a distance function, to that direction of arrival.

EEE 12: The method according to EEE 10 or 11, wherein a degree of priority is assigned to each of the speakers of the array of speakers; and wherein the distance function between a direction of arrival and a given speaker of the array of speakers depends on the degree of priority of the given speaker.

EEE 13: The method according to any one of EEEs 9 to 12, wherein smoothing the discrete panning function involves, for each speaker of the array of speakers:

for a given direction of arrival, determining a smoothed panning gain for that direction of arrival and for the respective speaker by calculating a weighted sum of the discrete panning gains for the respective speaker for directions of arrival among the plurality of directions of arrival within a window that is centered at the given direction of arrival.

EEE 14: The method according to EEE 13, wherein a size of the window, for the given direction of arrival, is determined based on a distance between the given direction of arrival and a closest one among the array of speakers.

EEE 15: The method according to EEE 13 or 14, wherein calculating the weighted sum involves, for each of the directions of arrival among the plurality of directions of arrival within the window, determining a weight for the discrete panning gain for the respective speaker and for the respective direction of arrival, based on a distance between the given direction of arrival and the respective direction of arrival.

EEE 16: The method according to any one of EEEs 13 to 15, wherein the weighted sum is raised to the power of an exponent that is in the range between 0.5 and 1.

EEE 17: The method according to any one of EEEs 8 to 16, wherein determining the rendering operation involves minimizing a difference, in terms of an error function, between an output of a first panning operation that is defined by a combination of the spatial panning function and a candidate for the rendering operation, and an output of a second panning operation that is defined by the target panning function.

EEE 18: The method according to EEE 17, wherein minimizing said difference is performed for a set of evenly distributed audio component signal directions as an input to the first and second panning operations.

EEE 19: The method according to EEE 17 or 18, wherein minimizing said difference is performed in a least squares sense.

EEE 20: The method according to any one of EEEs 8 to 16, wherein determining the rendering operation involves:

determining a set of directions of arrival;

determining a spatial panning matrix based on the set of directions of arrival and the spatial panning function;

determining a target panning matrix based on the set of directions of arrival and the target panning function;

determining an inverse or pseudo-inverse of the spatial panning matrix; and determining a matrix representing the rendering operation based on the target panning matrix and the inverse or pseudo-inverse of the spatial panning matrix.

EEE 21: The method according to any one of EEEs 8 to 20, wherein the rendering operation is a matrix operation.

EEE 22: The method according to any one of EEEs 8 to 21, wherein the intermediate signal format is a spatial signal format.

EEE 23: The method according to any one of EEEs 8 to 22, wherein the intermediate signal format is one of Ambisonics, Higher Order Ambisonics, or two-dimensional Higher Order Ambisonics.

EEE 24: An apparatus comprising a processor and a memory coupled to the processor, the memory storing instructions that are executable by the processor, the processor being configured to perform the method of any one of EEEs 1 to 23.

EEE 25: A computer-readable storage medium having stored thereon instructions that, when executed by a processor, cause the processor to perform the method of any one of EEEs 1 to 23.

EEE 26: Computer program product having instructions which, when executed by a computing device or system, cause said computing device or system to perform the method according to any of the EEEs 1 to 23.

The invention claimed is:

1. A method of converting an audio signal in an intermediate signal format to a set of speaker feeds suitable for playback of the audio signal by an array of speakers, wherein the audio signal in the intermediate signal format is obtainable from an input audio signal comprising a plurality of component audio signals by means of a spatial panning function that is independent of a speaker layout, the method comprising:

determining a discrete panning function for the array of speakers, wherein the discrete panning function defines a discrete panning gain for each speaker in the speaker layout for each of a plurality of directions of arrival;

determining, based on the discrete panning function, a target panning function, wherein the target panning function has properties that reduce or avoid undesired audible artifacts, and wherein determining the target panning function involves smoothing the discrete panning function; and determining a rendering operation for converting the audio signal in the intermediate signal format to the set of speaker feeds, based on the target panning function and the spatial panning function.

2. The method according to claim 1, wherein determining the discrete panning function involves, for each direction of arrival and for each speaker of the array of speakers:

determining the respective panning gain to be equal to zero if the respective direction of arrival is farther from the respective speaker, in terms of a distance function, than from another speaker; and determining the respective panning gain to be equal to a maximum value of the discrete panning function if the respective direction of arrival is closer to the respective speaker, in terms of the distance function, than to any other speaker.

3. The method according to claim 1, wherein the discrete panning function is determined by associating each direction of arrival with a speaker of the array of speakers that is closest, in terms of a distance function, to that direction of arrival.

4. The method according to claim 2, wherein a degree of priority is assigned to each of the speakers of the array of speakers; and wherein the distance function between a direction of arrival and a given speaker of the array of speakers depends on the degree of priority of the given speaker.

5. The method according to claim 1, wherein smoothing the discrete panning function involves, for each speaker of the array of speakers:

for a given direction of arrival, determining a smoothed panning gain for that direction of arrival and for the respective speaker by calculating a weighted sum of the discrete panning gains for the respective speaker for directions of arrival among the plurality of directions of arrival within a window that is centered at the given direction of arrival.

6. The method according to claim 5, wherein a size of the window, for the given direction of arrival, is determined based on a distance between the given direction of arrival and a closest one among the array of speakers.

7. The method according to claim 5, wherein calculating the weighted sum involves, for each of the directions of arrival among the plurality of directions of arrival within the window, determining a weight for the discrete panning gain for the respective speaker and for the respective direction of arrival, based on a distance between the given direction of arrival and the respective direction of arrival.

8. The method according to claim 5, wherein the weighted sum is raised to the power of an exponent that is in the range between 0.5 and 1.

9. The method according to claim 1, wherein determining the rendering operation involves:

determining a set of directions of arrival;

determining a spatial panning matrix based on the set of directions of arrival and the spatial panning function;

determining a target panning matrix based on the set of directions of arrival and the target panning function;

determining an inverse or pseudo-inverse of the spatial panning matrix; and determining a matrix representing the rendering operation based on the target panning matrix and the inverse or pseudo-inverse of the spatial panning matrix.

10. The method according to claim 1, wherein the intermediate signal format is one of Ambisonics, Higher Order Ambisonics, or two-dimensional Higher Order Ambisonics.

11. An apparatus comprising a processor and a memory coupled to the processor, the memory storing instructions that are executable by the processor, the processor being configured to perform the method of claim 1.

12. A non-transitory computer-readable storage medium having stored thereon instructions that, when executed by a processor, cause the processor to perform the method of claim 1.

13. A non-transitory computer program product having instructions which, when executed by a computing device or system, cause said computing device or system to perform the method according to claim 1.

14. The method of claim 11, wherein determining the rendering operation involves minimizing a difference, in terms of an error function, between an output of a first panning operation that is defined by the matrix representing the rendering operation, and an output of a second panning operation that is defined by the target panning matrix.

15. The method according to claim 14, wherein minimizing said difference is performed for a set of evenly distributed audio component signal directions as an input to the first and second panning operations.

16. The method according to claim 14, wherein minimizing said difference is performed in a least squares sense.

* * * * *